US007323825B2

(12) United States Patent
Hwang et al.

(10) Patent No.: US 7,323,825 B2
(45) Date of Patent: Jan. 29, 2008

(54) BALLAST INTEGRATED CIRCUIT (IC)

(75) Inventors: Jong-Tae Hwang, Seoul (KR); Dae-Ho Kim, Seoul (KR); Moon-Sang Jung, Seoul (KR); Dong-Hwan Kim, Gyeonggi-do (KR)

(73) Assignee: Fairchild Korea Semiconductor, Ltd., Bucheon-si (KR)

( * ) Notice: Subject to any disclaimer, the term of this patent is extended or adjusted under 35 U.S.C. 154(b) by 0 days.

(21) Appl. No.: 11/607,358

(22) Filed: Dec. 1, 2006

(65) Prior Publication Data

US 2007/0145907 A1 Jun. 28, 2007

(30) Foreign Application Priority Data

Dec. 2, 2005 (KR) ..... 10-2005-0117245

(51) Int. Cl.
*H05B 37/02* (2006.01)

(52) U.S. Cl. ..... 315/224; 315/226; 315/300; 315/302; 315/308

(58) Field of Classification Search ..... 315/209 R, 315/224, 225, 226, 209 M, 291, 299, 300, 315/302, 307, 308
See application file for complete search history.

(56) References Cited

U.S. PATENT DOCUMENTS 6,002,213 A 12/1999 Wood ..... 315/307
6,008,593 A * 12/1999 Ribarich ..... 315/307
6,211,623 B1 * 4/2001 Wilhelm et al. ..... 315/224
6,525,492 B2 2/2003 Ribarich ..... 315/291
6,879,115 B2 4/2005 Ribarich ..... 315/224
6,891,339 B2 5/2005 Ribarich et al. ..... 315/291
6,956,336 B2 * 10/2005 Ribarich ..... 315/247

* cited by examiner

*Primary Examiner*—Thuy Vinh Tran
(74) *Attorney, Agent, or Firm*—Sidley Austin LLP

(57) ABSTRACT

A ballast integrated circuit (IC) for driving a first switching element and a second switching element includes: a variable gain amplifier (VGA) connected to a first input terminal connected to a resistor, for generating an output current signal according to a resistance value of the resistor and a gain control signal; a preheating/ignition controller connected to a second input terminal connected to a capacitor, for generating an output current signal and an output voltage signal acting as the gain control signal according to a voltage of the second input terminal; an active zero-voltage controller for generating a hard-switching current signal and an active zero-voltage switching current signal, such that it adjusts the voltage of the second input terminal according to switching states of the first switching element and the second switching element; an oscillator for generating an oscillation signal upon receiving the output current signal from the variable gain amplifier (VGA); and a dead-time controller for receiving the voltage signal of the second input terminal and an output signal of the oscillator, adjusting a dead time using the received signals, and at the same time generating driving signals of the first and second switching elements.

12 Claims, 20 Drawing Sheets

BALLAST INTEGRATED CIRCUIT (IC)

CROSS REFERENCE TO RELATED APPLICATION

This application claims the benefit of Korean Patent Application No. 10-2005-117245, filed on Dec. 2, 2005, in the Korean Intellectual Property Office, the disclosure of which is incorporated herein in its entirety by reference.

BACKGROUND OF THE INVENTION

1. Field of Invention

The present invention relates to a ballast integrated circuit (IC), and more particularly to a ballast IC for automatically adjusting a dead time according to load characteristics.

2. Description of Related Art

FIG. 1 is a circuit diagram illustrating a fluorescent-lamp driving circuit including a conventional ballast IC. FIG. 2 is a graph illustrating operations of the ballast IC of FIG. 1. In FIG. 2, a horizontal axis indicates a frequency, and a vertical axis indicates a magnitude.

The inverter circuit for driving the fluorescent lamp 100 includes first and second switching elements 121 and 122 operated by ballast IC 110. The first switching element 121 and the second switching element 122 can be N-channel MOS transistors. Gate terminals of the first and second switching elements 121 and 122 are connected to the ballast IC 110. A DC voltage $V_{DC}$ is applied to a drain terminal of the first switching element 121, and a source terminal of the first switching element 121 is connected to the drain terminal of the second switching element 122 and the output node (a). The drain terminal of the second switching element 122 is coupled to the source terminal of the first switching element 121 and the output node (a), and the source terminal of the second switching element 122 is grounded.

A first resonance capacitor $C_S$ for resonance is coupled between the output node (a) and the fluorescent lamp 100, and a second resonance capacitor $C_P$ is coupled in parallel to the fluorescent lamp 100. An inductor L for limiting a current signal is coupled between the output node (a) and the first resonance capacitor $C_S$, and an equivalent capacitor $C_{CP}$ for use in a charge pump is connected in parallel to the inductor L.

The above-mentioned driving circuit drives the first and second switching elements 121 and 122, generates an AC output voltage $V_O$ in the form of a square wave signal via the output node (a), and drives the fluorescent lamp 100. In this implementation the ballast IC 110 compensates for negative impedance characteristics of the fluorescent lamp 100, such that it ballasts (or stabilizes) the current signal when driving the first and second switching elements 121 and 122. The fluorescent lamp may be considered to be a single load resistor $R_L$. In this case, the load resistor $R_L$ is connected in parallel to the second resonance capacitor $C_P$.

Therefore, the characteristics of the resonance circuit composed of first and second resonance capacitors $C_S$ and $C_p$ and the load resistor $R_L$ vary according to the magnitude of the load resistor $R_L$. The ballast IC is operated in three different modes according to the different resonance-circuit characteristics.

Referring to FIG. 2, no current will flow if the fluorescent lamp 100 is switched off. This can be represented as a load resistance $R_L$ with a very high resistance. Therefore, the resonance curve of the resonant circuit will have a very steep slope and a very high resonance peak value, as denoted by the graph 210. Here a load resistance $R_L$ of 100 kΩ was assumed. However, if the fluorescent lamp 100 is switched on, the load resistance $R_L$ decreases. This lowers the resonance peak value and the resonance frequency, as can be seen from the graph 220, 230, or 240. Graph 220 indicates a load resistance $R_L$ of 10 kΩ, graph 230 indicates a load resistance $R_L$ of 1 kΩ, and graph 240 indicates a load resistance $R_L$ of 500Ω.

According to the above-mentioned resonance characteristics, the ballast IC drives the fluorescent lamp 100 using three modes: a preheating mode, an ignition mode, and a running mode. The fluorescent lamp 100 is sequentially driven in the order of the preheating mode→ignition mode→running mode.

During the preheating mode, denoted by "A" in FIG. 2, the fluorescent lamp 100 is driven at a frequency higher than a resonance frequency corresponding to the very high load resistance $R_L$. During the preheating mode, the current signal does not flow in the fluorescent lamp 100. Instead, it flows in a filament contained in the fluorescent lamp 100 and a second resonance capacitor $C_P$. The hot electrons can be easily emitted by the above-mentioned current signal.

During the ignition mode, denoted by "B" in FIG. 2, the fluorescent lamp 100 is switched on by the increasing voltage VL between the ends of the fluorescent lamp 100 because it quickly reduces a frequency for a predetermined time shorter than the time of the preheating mode.

If the fluorescent lamp 100 did not break down, no faulty- or erroneous-operation occurred, or there was no error in the circuit, the running mode allows the fluorescent lamp 100 to be driven at a constant frequency.

The running mode, denoted by "C" of FIG. 2, occurs after the fluorescent lamp 100 switched on. The lower the load resistance RL, the lower the resonance peak value and the lower the quality factor Q of the resonance circuit. The driving frequency is generally set to a specific frequency slightly less than the resonance frequency of the resonance circuit. The resonance frequency of the resonance circuit is distinguished by the fluorescent lamp 100 having infinite resistance at that frequency—at least in principle.

The described driving circuit is based on a zero-voltage switching control scheme. Generally, the zero-voltage switching indicates a specific switching technique capable of switching on the MOS transistor when a voltage difference between a drain terminal and a source terminal of the MOS transistor is almost zero, thereby minimizing the conduction loss and the EMI (Electro-Magnetic Interference).

Typically, the absence of zero-voltage switching indicates that the load resistance $R_L$ is extremely high or is not present. In this case, the resonance frequency of the resonance circuit is higher than the frequency of the running mode, such that the driving circuit is driven at a frequency lower than the resonance frequency of the resonance circuit.

In this case, the resonance circuit is operated similarly with the capacitive load (also called capacitor load), such that the current signal of the inductor L is leading the phase of the output voltage Vo. As a result, a so-called "hard switching" occurs instead of zero-voltage switching.

During hard switching the output signal is changed by the switching operation and the switch is switched on by a maximum voltage. In this case, the conduction loss is high, and an abrupt current flow occurs in the switch, resulting in a high level of EMI. Also, the IC may be operated erroneously. Typically, most of the ballast ICs connect a capacitor $C_{CP}$ to an output terminal of the driving circuit and generate an auxiliary power-supply using the current signal of the capacitor $C_{CP}$. This generates an operating voltage of the IC using the voltage signal of the auxiliary power-supply. The current signal of the capacitor $C_{CP}$ is determined by the rising slope of the output voltage Vo. The slope of the output voltage Vo is very steep, such that the current signal of the capacitor $C_{CP}$ increases and the increasing current signal encounters a high-voltage peak in the auxiliary power-supply unit. These can generate a high-frequency noise in the IC, such that the IC may be erroneously operated.

FIGS. 3A-3D are circuit diagrams illustrating the zero-voltage switching operation of the ballast IC shown in FIG. 1. FIG. 4 is a timing diagram illustrating signal states of individual circuits of FIGS. 3A-3D.

In FIG. 3A and FIG. 4, a high-side input signal HIN drives the first switching element 121, and a low-side input terminal LIN drives the second switching element 122. During a period $T_1$ in which only the first switching element 121 is switched on, the resonance current flows in the inductor L, and the resonance frequency is less than a driving frequency as denoted by "C" in FIG. 2, such that the resonance current is lagging the driving-voltage phase. As a result, the current signal flows in the (negative (−)) direction from the inductor L to the driving circuit. After a time interval, the current direction changes by a current signal generated from the first switching element 121, and the changed current increases in time.

In FIG. 3B and FIG. 4, during an interval Td in which the first switching element 121 and the second switching element 122 are switched off, the current signal of the inductor L flows in the capacitor $C_{CP}$, and the capacitor $C_{CP}$ voltage is gradually reduced. Since the interval $T_d$ is very short, a DC current is provided regardless of a variation of the inductor L current. This reduces the output voltage Vo along the almost-constant slope by the capacitor $C_{CP}$ and the inductor L current.

In FIG. 3C and FIG. 4, the current direction of the inductor L is not changed after the capacitor $C_{CP}$ voltage drops to zero by the inductor L current, a diode D2 connected in parallel to the second switching element 122 is switched on during the period $T_3$, such that the current signal flows in the ballast IC. In this case, the ON voltage of the diode D2 is applied to the drain and source terminals of the second switching element 122.

In FIG. 3D and FIG. 4, the capacitor $C_{CP}$ voltage reaches 0V, or if the second switching element 122 is switched on during the interval $T_4$, a voltage between the drain terminal and the source terminal of the second switching element 122 becomes extremely low, such that an almost zero-voltage switching is performed. Although the second switching element 122 is switched on, the current does not vary with time, so that EMI, generated by the time derivative of the current, "di/dt", does not occur. Since the voltage between the drain terminal and the source terminal is almost 0V, there will be minimal conduction loss in the ballast IC, caused by the ON resistance of the MOS transistor.

The above-mentioned interval $T_d$ is generally called a dead time. Generally, the ballast IC guarantees the above-mentioned dead time. However, if the dead time is not properly adjusted according to load states, the zero-voltage switching may be incorrectly performed. If a faulty- or erroneous-operation occurs, the system may not be protected from danger and harm, making it is impossible to guarantee the stability of the system.

SUMMARY OF THE INVENTION

In accordance with the present invention, the above and other objects can be and a second switching element comprising: a variable gain amplifier VGA connected to a first input terminal connected to a resistor, for generating an output current signal according to a resistance value of the resistor and a gain control signal; a preheating/ignition controller connected to a second input terminal connected to a capacitor, for generating an output current signal and an output voltage signal acting as the gain control signal according to a voltage of the second input terminal; an active zero-voltage controller for generating a hard-switching current signal and an active zero-voltage switching current signal, such that it adjusts the voltage of the second input terminal according to switching states of the first switching element and the second switching element; an oscillator for generating an oscillation signal upon receiving the output current signal from the variable gain amplifier VGA; and a dead-time controller for receiving the voltage signal of the second input terminal and an output signal of the oscillator, adjusting a dead time using the received signals, and at the same time generating driving signals of the first and second switching elements.

In some embodiments, the ballast integrated circuit IC further comprises: a voltage/current converter for converting a voltage signal of the first input terminal into a current signal, and transmitting the current signal to the variable gain amplifier VGA.

In some embodiments, the ballast integrated circuit IC further comprises: an edge detector for detecting a rising- or falling-edge generated at an output voltage of an output unit equipped with the first and second switching elements using a first or second terminal of an auxiliary power-supply unit capable of driving the first switching element, generating an edge detection signal, and transmitting the edge detection signal to the active zero-voltage switching controller.

In some embodiments, the edge detector includes a MOS transistor, connects a first terminal of the MOS transistor to the first or second terminal of the auxiliary power-supply unit, and allows a current signal proportional to a variation of the output voltage to flow in a parasitic capacitor arranged between the first terminal and the second terminal of the MOS transistor according to the variation of the output voltage.

In some embodiments, the edge detector includes: a MOS transistor including the parasitic capacitor arranged between the first terminal and the second terminal, connecting the first terminal to the first or second terminal of the auxiliary power-supply unit, and receiving an amount of the variation of the output voltage; a voltage/current converter for converting a current signal generated from the second terminal of the MOS transistor into a voltage signal; first and second comparators for generating a rising-edge detection signal and a falling-edge detection signal according to an output signal of the voltage/current converter, respectively; and an OR gate for receiving the rising-edge detection signal and the falling-edge detection signal, performing a logic OR operation on the received detection signals, and generating the OR-operation resultant signal as the edge detection signal.

In some embodiments, the edge detector includes a diode, connects a first terminal of the diode to a first or second terminal of the auxiliary power-supply unit, and allows a current signal proportional to a variation of the output voltage to flow in a parasitic capacitor arranged between the first terminal and the second terminal of the diode according to the variation of the output voltage.

In some embodiments, the edge detector includes: a diode including the parasitic capacitor arranged between the first terminal and the second terminal, connecting the first terminal to the first or second terminal of the auxiliary power-supply unit, and receiving an amount of the variation of the output voltage; a voltage/current converter for converting a current signal generated from the second terminal of the diode into a voltage signal; first and second comparators for generating a rising-edge detection signal and a falling-edge detection signal according to an output signal of the voltage/current converter, respectively; and an OR gate for receiving the rising-edge detection signal and the falling-edge detection signal, performing a logic OR operation on the received detection signals, and generating the OR-operation resultant signal as the edge detection signal.

In some embodiments, the active zero-voltage switching controller determines whether the first and second switching elements perform a hard switching operation or a zero-voltage switching operation by referring to the edge detection signal, whereby if the hard switching operation is determined, the active zero-voltage switching controller generates the hard-switching current signal, and if the active zero-voltage switching operation is determined, the active zero-voltage switching controller generates the active zero-voltage switching current signal.

In some embodiments, the ballast integrated circuit (IC) further comprises: a mode detector for determining whether a preheating mode and an ignition mode are completed by referring to the voltage of the second input terminal, and transmitting an enable signal to the active zero-voltage switching controller after detecting the completion of the preheating and ignition modes.

In some embodiments, the mode detector, if the voltage of the second input terminal is equal to or higher than a predetermined magnitude, recognizes a dead-time control mode, generates the enable signal, stops operation of the preheating/ignition controller, and activates operations of the active zero-voltage switching controller.

In some embodiments, the ballast integrated circuit (IC) further comprises: an under voltage lock-out (UVLO) unit for transmitting a reset signal to the mode detector if a power-supply voltage is equal to or less than a predetermined magnitude required for normal operations, thereby stopping operation of the ballast IC.

In some embodiments, the mode detector, if the voltage of the second input terminal is equal to or higher than a predetermined magnitude, recognizes a dead-time control mode, generates the enable signal, stops operation of the preheating/ignition controller, and activates operations of the active zero-voltage switching controller, determines if the voltage of the second input terminal is equal to or less than a predetermined magnitude, and finally stops operation of the ballast IC when the voltage of the second input terminal is equal to or less than a predetermined magnitude.

BRIEF DESCRIPTION OF THE DRAWINGS

The above and other objects, features and other advantages of the present invention will be more clearly understood from the following detailed description taken in conjunction with the accompanying drawings, in which.

DETAILED DESCRIPTION

Figure 1:
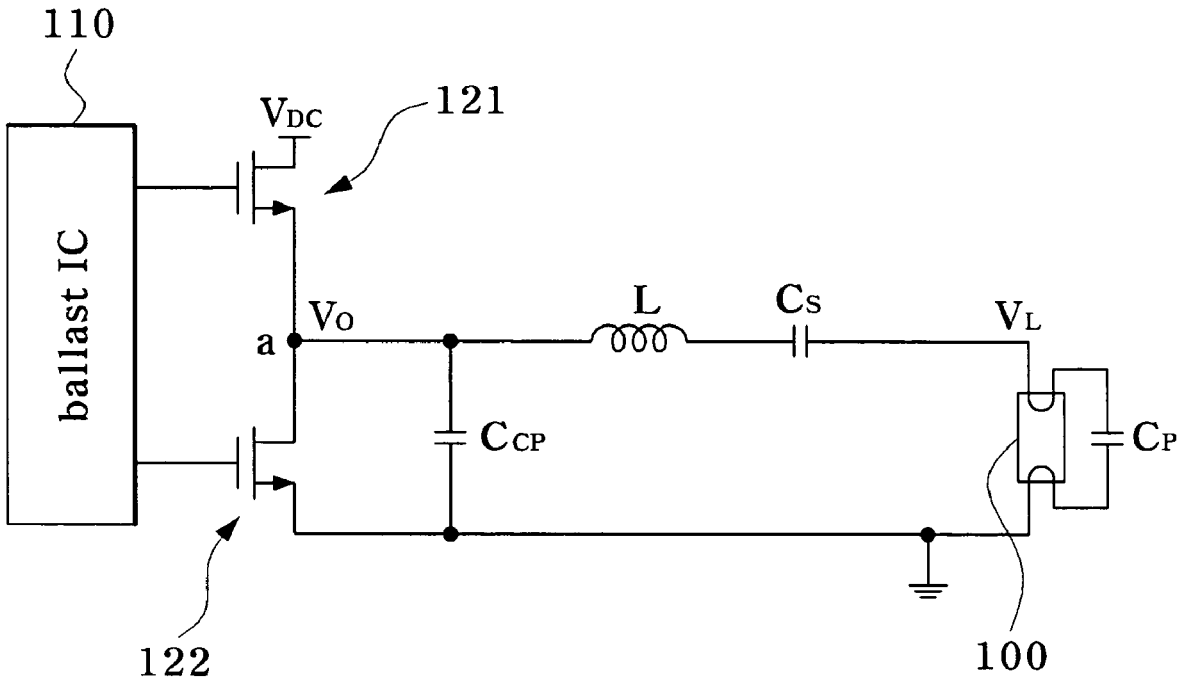
FIG. 1 (PRIOR ART)
FIG. 1 is a circuit diagram illustrating a fluorescent-lamp driving circuit including a conventional ballast IC.

The present invention will be described in detail with reference to the annexed drawings. In the drawings, the same or similar elements are denoted by the same reference numerals. In the following description, a detailed description of known functions and configurations incorporated herein will be omitted for clairity.

Figure 5:
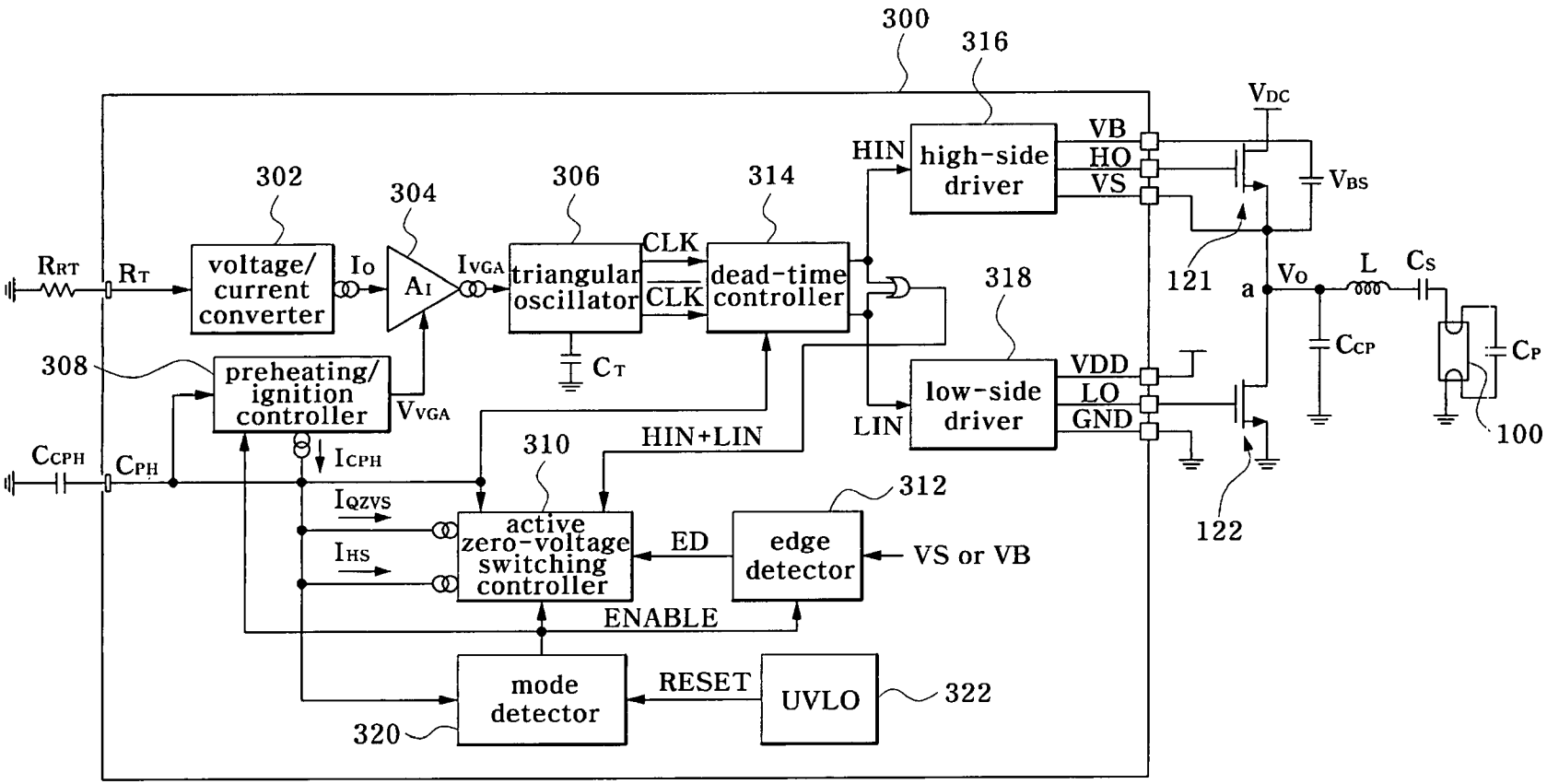
FIG. 5 is a circuit diagram illustrating a ballast IC.

FIG. 5 is a circuit diagram illustrating a ballast IC 300. In some embodiments, the ballast IC 300 includes two input terminals RT and CPH, and six output terminals: VB, HO, VS, VDD, LO, and GND. The ballast IC 300 includes a voltage/current converter (also called a "V/I converter") 302, a variable gain amplifier (VGA) 304, a triangular oscillator (also called a saw-tooth oscillator) 306, a preheating/ignition controller 308, an active zero-voltage switching controller 310, an edge detector 312, a dead-time controller 314, a high-side driver 316, a low-side driver 318, a mode detector 320, and a UVLO (Under Voltage Lock-Out) unit 322.

The voltage/current converter 302 allows an external user to adjust the running-mode frequency using a resistor $R_{RT}$ connected in series to the first input terminal RT. The output current $I_o$ of the voltage/current converter 302 is controlled by the resistor $R_{RT}$.

The Variable Gain Amplifier 304 receives the output current $I_o$ of the voltage/current converter 302, amplifies the received current $I_o$ using a gain determined by the output voltage $V_{VGA}$ of the preheating/ignition controller 308, and generates the output current $I_{VGA}$.

The triangular oscillator 306 receives the output current $I_{VGA}$ of the VGA 304, performs charging/discharging of the capacitor CT connected to the triangular oscillator 306, and finally generates a clock signal CLK and an inverted clock signal $\overline{CLK}$.

The preheating/ignition controller 308 receives an input signal via the second input terminal CPH. The capacitor $C_{CPH}$ is connected in series to the second input terminal CPH. The preheating/ignition controller 308 determines the preheating time and the ignition time by changing the current signal $I_{CPH}$ charged in the capacitor $C_{CPH}$ according to the capacitor $C_{CPH}$ voltage. The value of the current signal $I_{CPH}$ is reduced during the preheating mode, whereas it increases during the ignition mode.

The magnitude of the current signal $I_{CPH}$ is maintained during the dead-time control mode. The output voltage $V_{VGA}$ generated from the preheating/ignition controller 308 determines the gain AI of the VGA 304. The output voltage $V_{VGA}$ increases during the preheating mode, such that the output current $I_{VGA}$ of the VGA 304 is higher than the input current $I_O$. In this case, the charging/discharging speed of the capacitor CT connected to the triangular oscillator 306 increases, such that the frequency of the clock signal (CLK) generated from the triangular oscillator 306 is higher than the resonance frequency.

If the voltage of the second input terminal CPH is in the ignition mode, the output voltage $V_{VGA}$ will be generated inversely proportional to the above-mentioned CPH voltage. In this case, the higher the CPH voltage, the lower the output current $I_{VGA}$ of the VGA 304. The higher the CPH voltage, the lower the charging/discharging speed of the capacitor CT connected to the triangular oscillator 306. Therefore, the lamp driving frequency is lower than the resonance frequency. If the CPH voltage is equal to or higher than a specific voltage, the running mode begins, and the output current $I_{VGA}$ of the VGA 304 is equal to the input current $I_O$, such that the running mode is activated at the frequency determined by the first input terminal RT.

In conjunction, the preheating/ignition controller 308 is activated when the enable signal ENABLE of the mode detector 320 assumes a low level. If the enable signal ENABLE of the mode detector 320 assumes a high level, the preheating/ignition controller 308 does not adjust the current signal $I_{CPH}$ caused by the CPH voltage and the output current $I_{VGA}$. In this case, the current signal $I_{CPH}$ is maintained at a predetermined value, and the output voltage $V_{VGA}$ is generated as a specific voltage capable of allowing the gain AI of the VGA 304 to be unity, "1".

The active zero-voltage switching controller 310 is operated in the dead-time control mode, and determines a switching state using not only the input signal HIN of the high-side driver 316 and the input signal LIN of the low-side driver 318, but also the rising/falling information signal ED of the edge detector 312. The active zero-voltage switching controller 310 detects a quasi-ZVS (quasi zero-voltage switching) state and a hard-switching state HS, and discharges the capacitor $C_{CPH}$ using the quasi-ZVS current $I_{QZVS}$ and the hard-switching current $I_{HS}$, thereby adjusting the CPH voltage of the second input terminal CPH.

The edge detector 312 is connected to the output terminals VS and VB. It detects the rising/falling edges of the output signal of the half-bridge inverter circuit, and generates the rising/falling information signal ED. The dead-time controller 314 adjusts the dead-time according to the CPH voltage of the second input terminal CPH. If the CPH voltage is low, the dead-time controller 314 increases the dead time. If the CPH voltage is high, the dead-time controller 314 reduces the dead time.

The high-side driver 316 generates the high-side output signal HO for driving the first switching element 121 upon receiving the high-side input signal HIN from the dead-time controller 314. The low-side driver 318 generates the low-side output signal LO for driving the second switching element 122 upon receiving the low-side input signal LIN from the dead-time controller 314.

The mode detector 320 detects the completion of the preheating and ignition modes using the voltage of the second input terminal CPH, and determines whether the dead-time control mode begins. The UVLO unit 322 detects the power-supply voltage $V_{DD}$, and determines whether the ballast IC 300 is normally operated by referring to the power-supply voltage $V_{DD}$. If the power-supply voltage $V_{DD}$ is equal to or less than a normal-operation voltage, the UVLO unit 322 generates the reset signal RESET, and stops operating the remaining circuits other than the UVLO unit 322 itself, such that it prevents faulty or erroneous operations from being generated.

Figure 2:
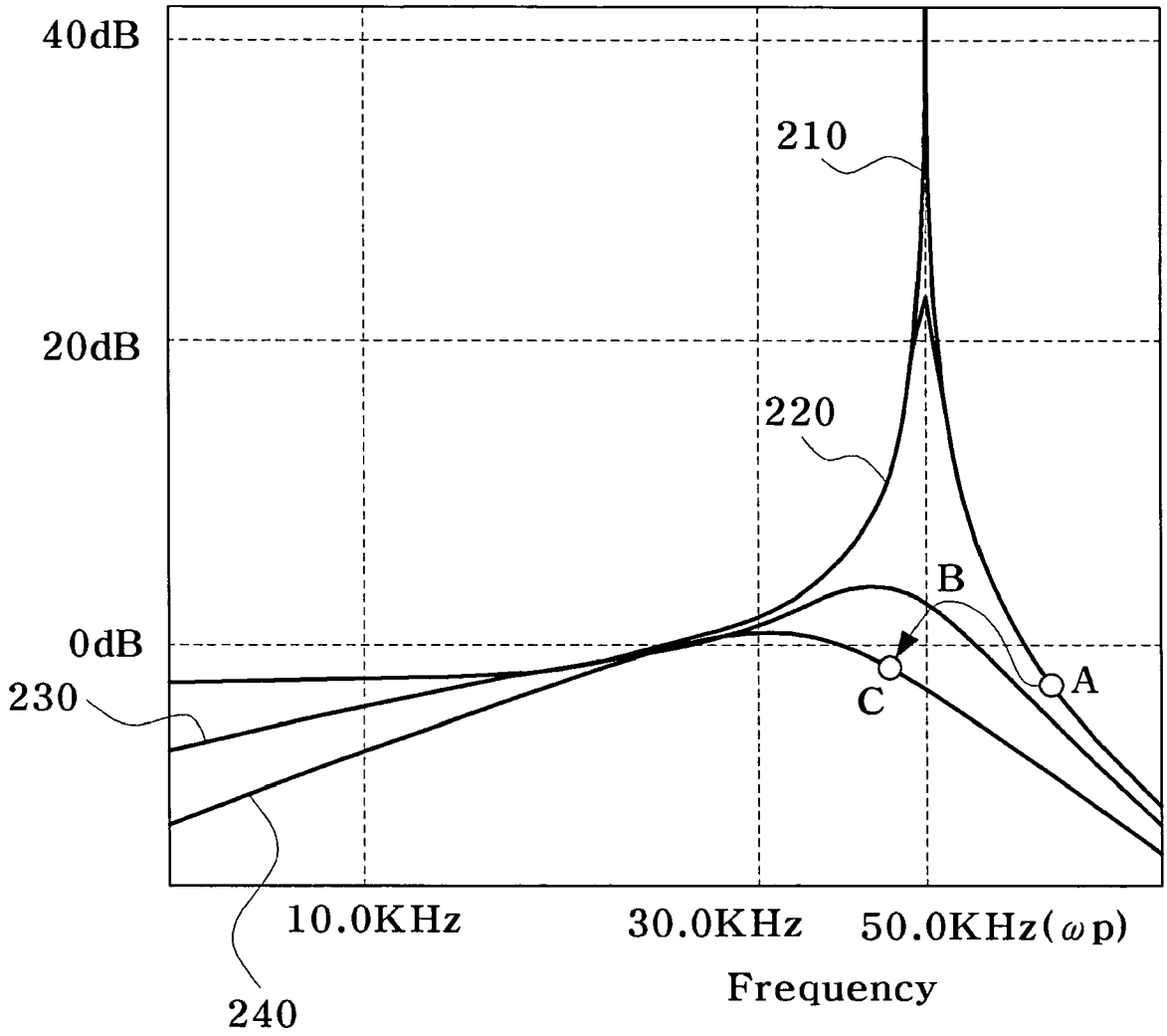
FIG. 2 (PRIOR ART)
FIG. 2 is a graph illustrating a variation of characteristics of a resonance tank including a lamp according to driving states of the ballast IC shown in FIG. 1.
Figure 3A:
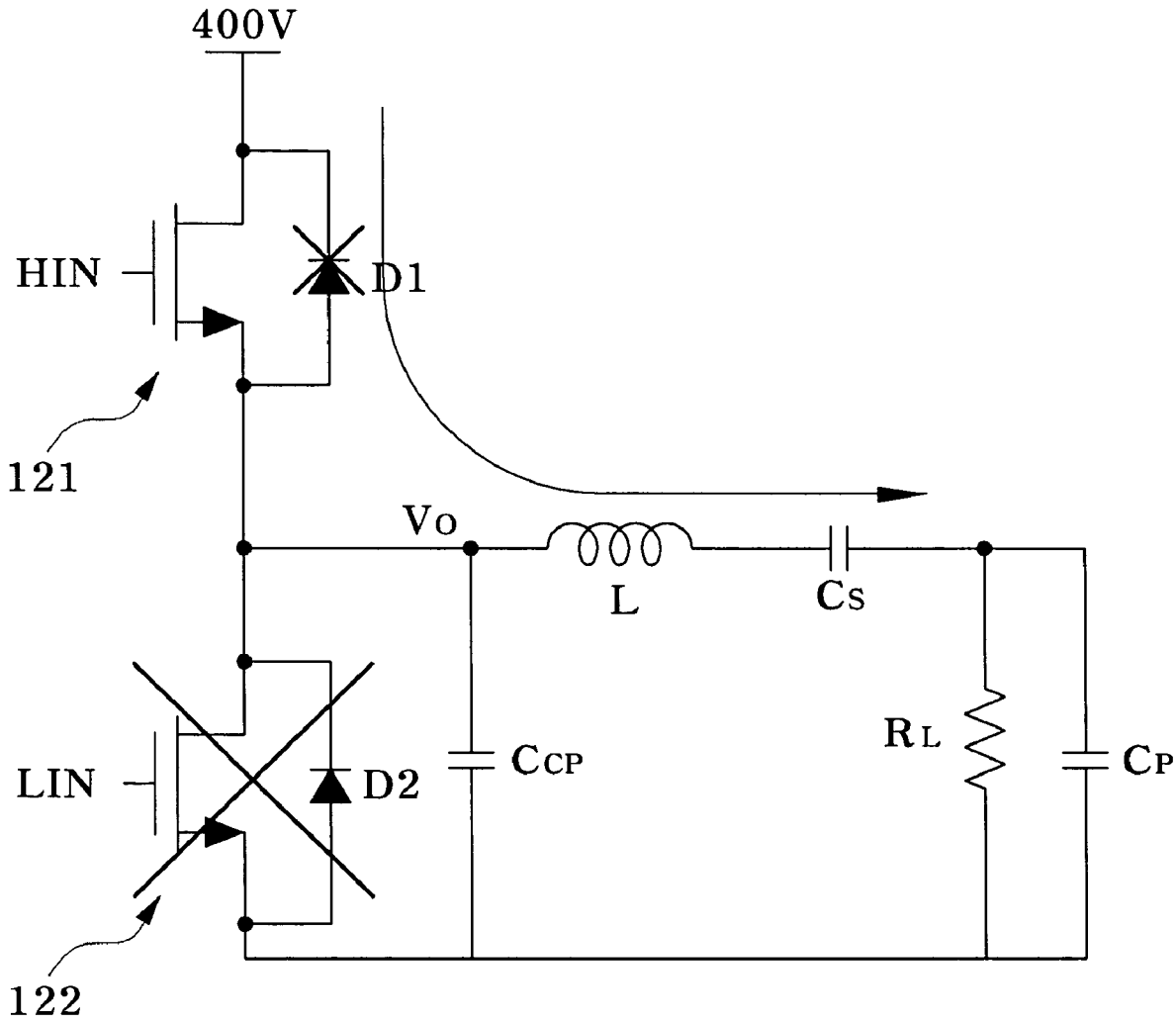
FIG. 3A (PRIOR ART)
FIGS. 3A-3D are circuit diagrams illustrating the zero-voltage switching operation of the ballast IC shown in FIG. 1.
Figure 3B:
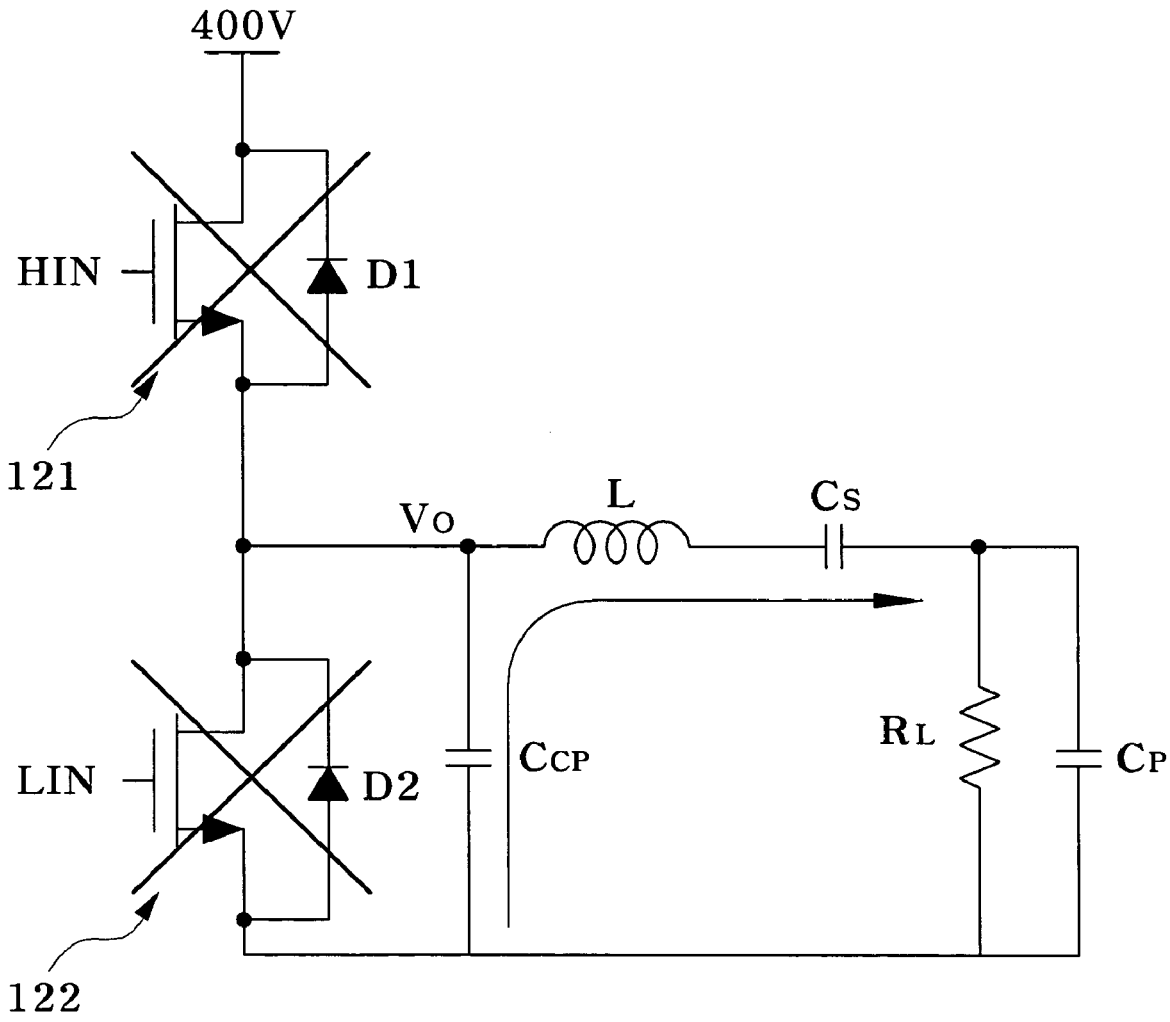
FIG. 3B (PRIOR ART)
Figure 3C:
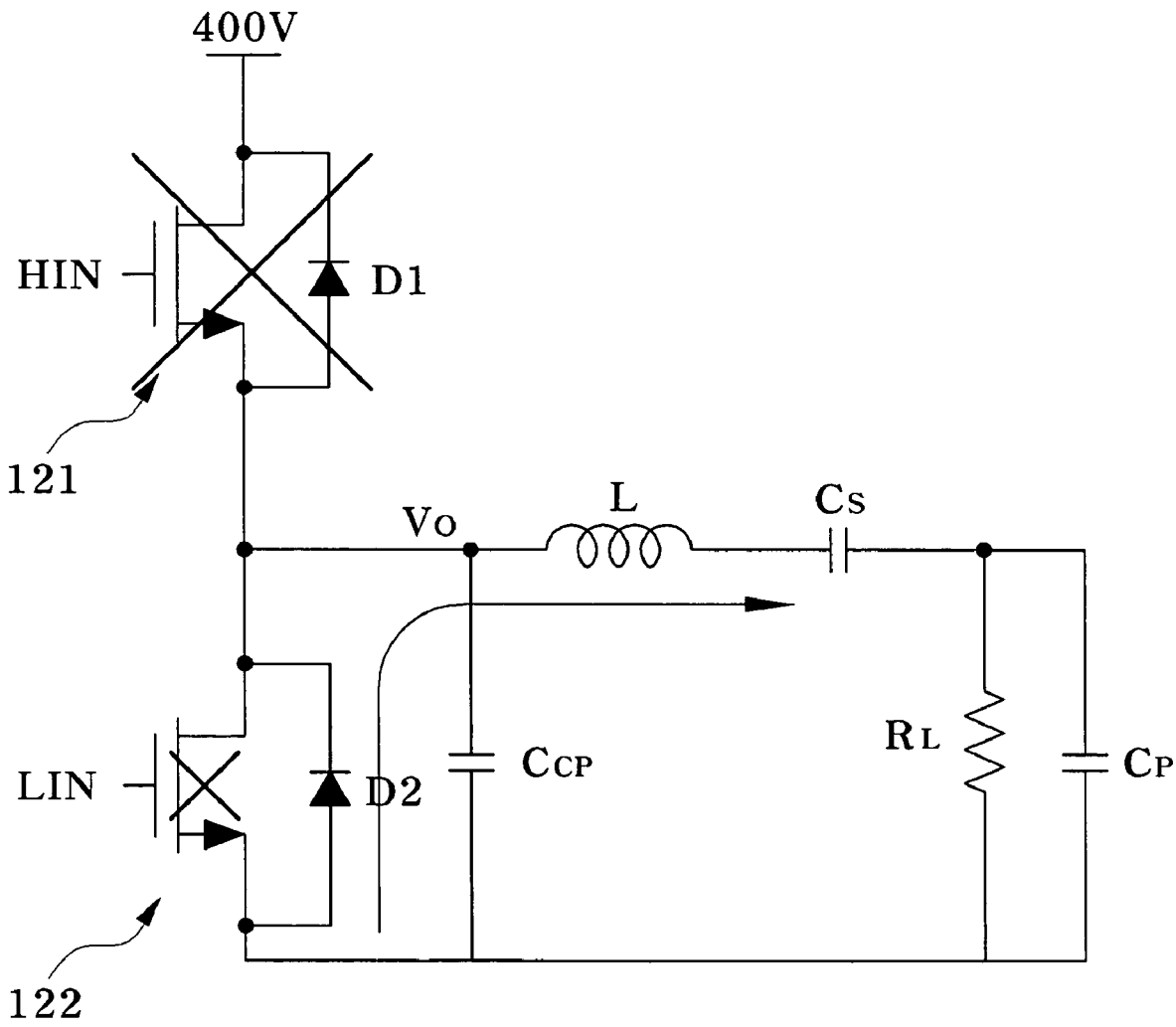
FIG. 3C (PRIOR ART)
Figure 3D:
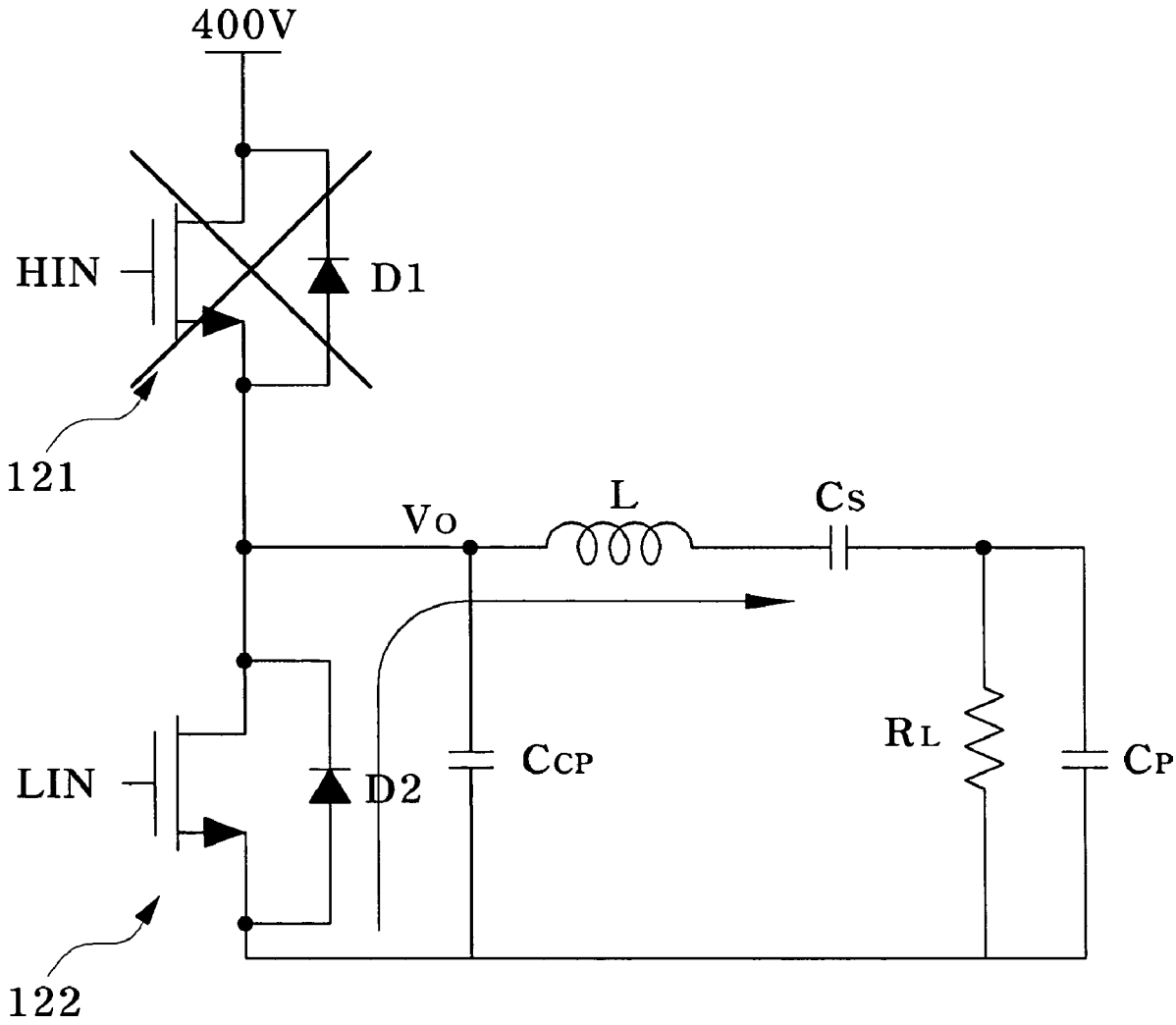
FIG. 3D (PRIOR ART)
Figure 4:
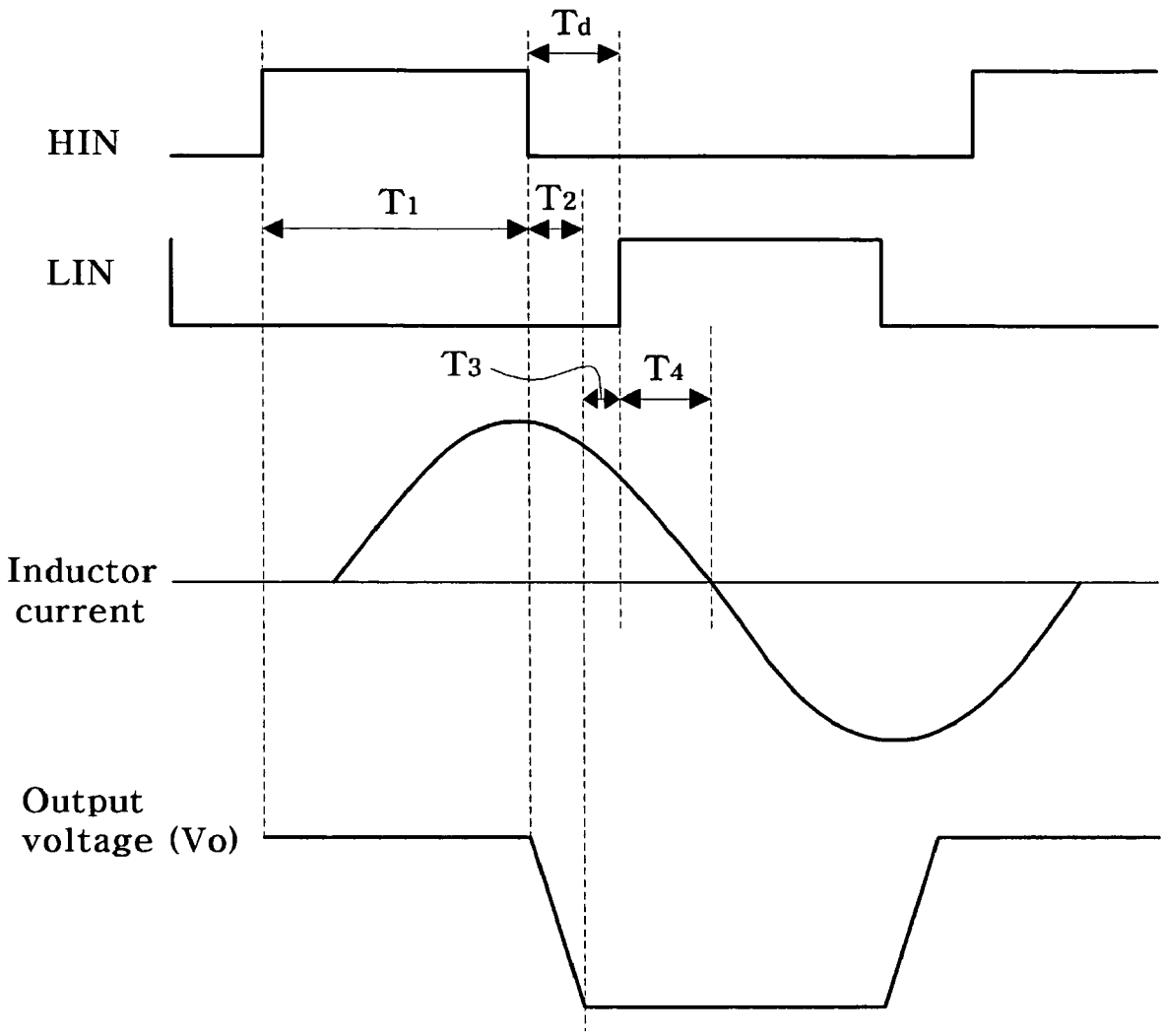
FIG. 4 (PRIOR ART)
FIG. 4 is a timing diagram illustrating signal states of individual circuits of FIGS. 3A-3D.
Figure 6:
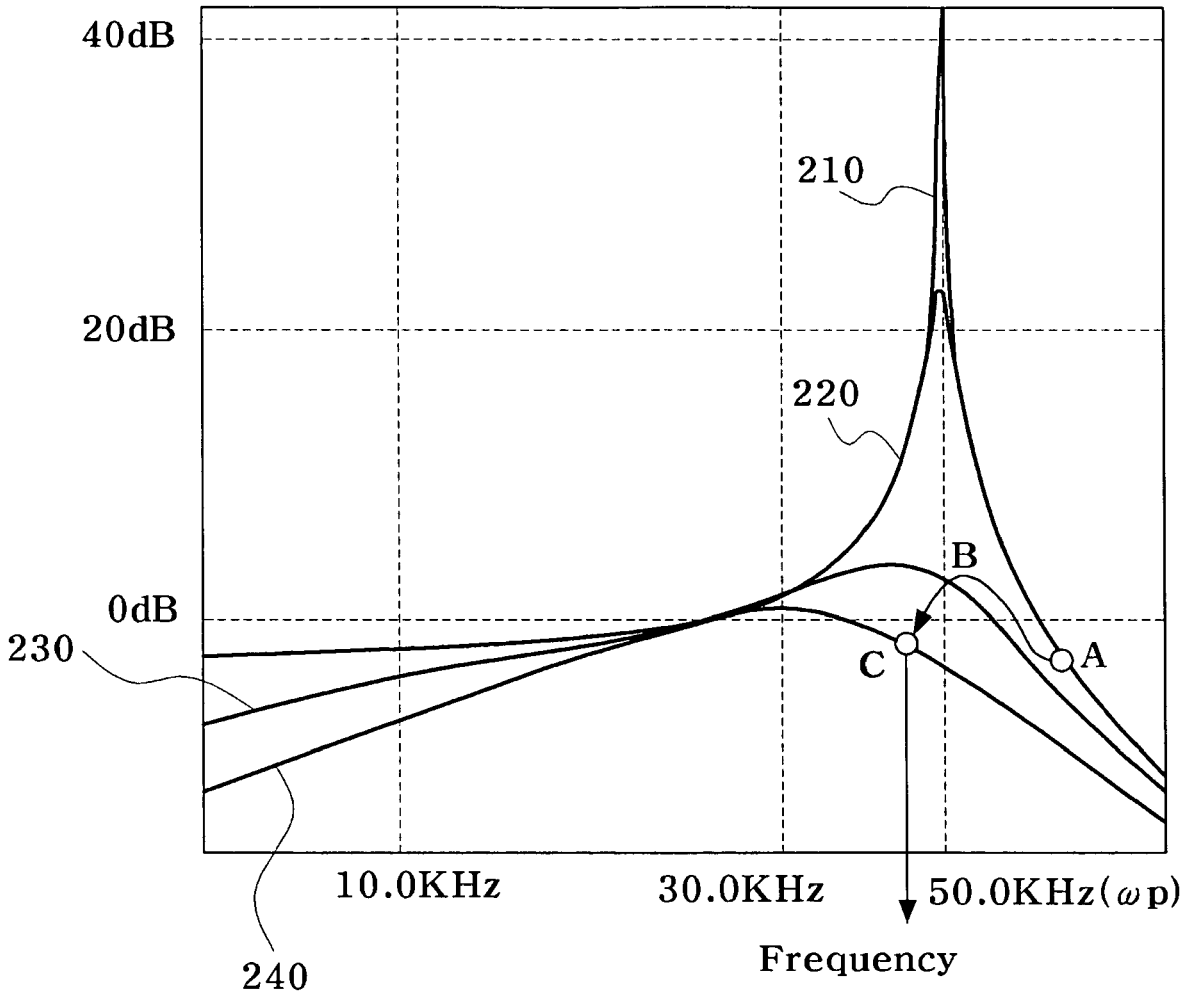
FIG. 6 is a graph illustrating operations of the ballast IC shown in FIG. 5.

FIG. 6 is a graph illustrating operations of the ballast IC shown in FIG. 5. In some embodiments, the ballast IC 300 includes the preheating mode (A), the ignition mode (B), the running mode (C), and the dead-time control mode (D). The preheating mode (A), the ignition mode (B), and the running mode (C) have already been described in FIG. 2.

The dead-time control mode (D) detects operation states of the first and second switching elements 121 and 122 using the ballast IC 300. If the zero-voltage switching is not performed, the dead time can be automatically controlled by the dead-time control mode (D).

If it is determined that the running mode begins, the first and second switching elements 121 and 122 are simultaneously switched off on the condition that a frequency is fixed to a predetermined value, such that the dead-time control mode (D) performs the active control operation capable of allowing the first and second switching elements 121 and 122 to perform the zero-voltage switching operation. If it is determined that the zero-voltage switching is not performed by referring to the operation states of the first and second switching elements 121 and 122, the dead time increases. If it is determined that the zero-voltage switching is not performed on the condition that the dead time maximally increases, the first and second switching elements 121 and 122 are switched off, and the ballast IC 300 enters the shut-down mode.

Figure 7:
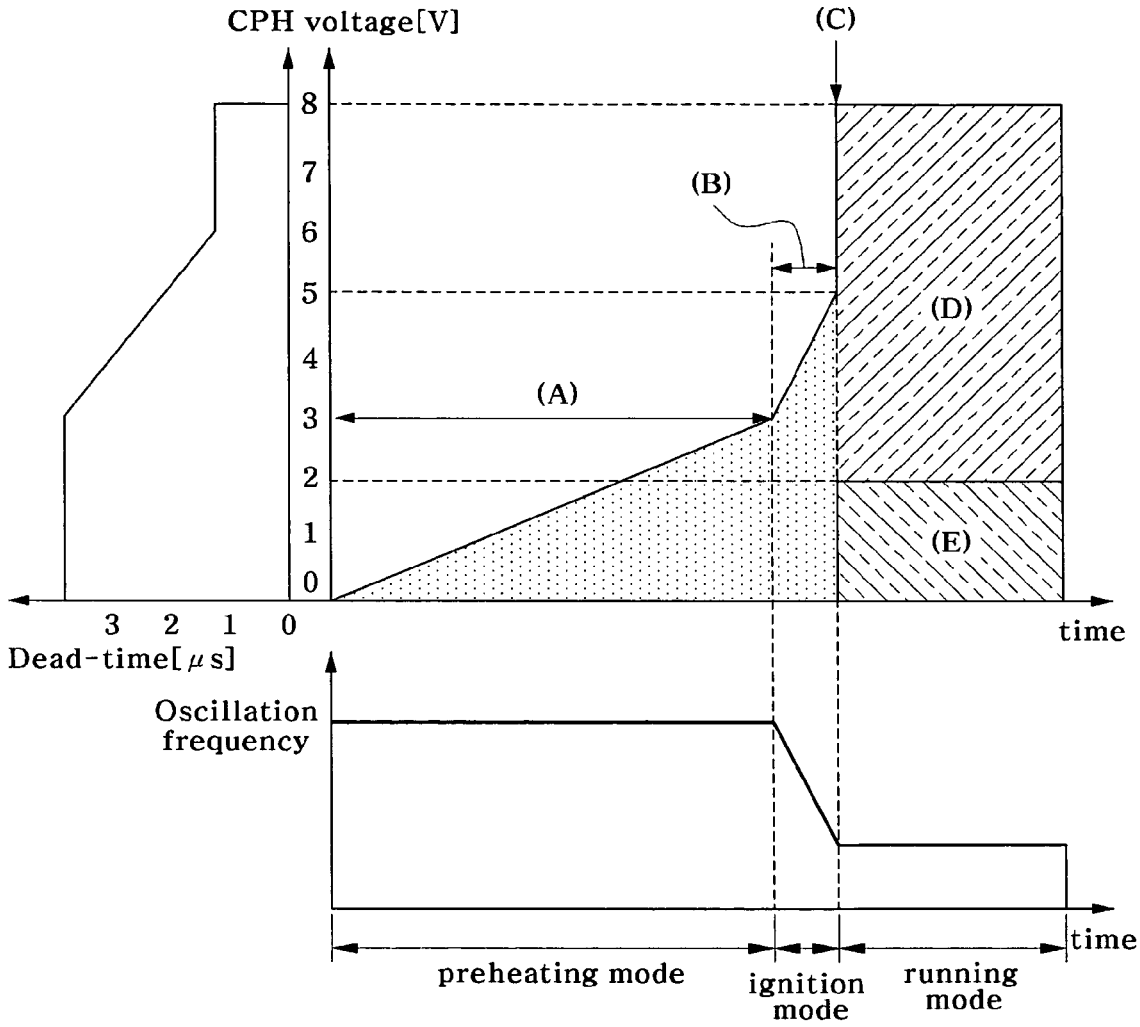
FIG. 7 is a graph illustrating second input terminal (CPH)'s time-variant voltage characteristics of the ballast IC shown in FIG. 5 and operation modes of the ballast IC.

FIG. 7 is a graph illustrating the second input terminal CPH's time-dependent voltage characteristics of the ballast IC shown in FIG. 5 and operation modes of the ballast IC according to the present invention.

In some embodiments, the ballast IC 300 performs a variety of functions using the second input terminal CPH. There are three operation modes based on the CPH voltage. In the first mode, the CPH voltage can be in the range from 0V to 3V, and the enable signal ENABLE generated from the edge detector 312 of FIG. 5 assumes a low level. In the second mode, the CPH voltage can be in the range from 3V to 5V, and the enable signal ENABLE generated from the edge detector 312 of FIG. 5 assumes a low level. In the third mode, the CPH voltage can be higher than 5V, and the enable signal ENABLE generated from the edge detector 312 of FIG. 5 assumes a low level.

In the first mode, as denoted by (A) in FIG. 7, the CPH voltage can be equal to or less than 3V. The CPH voltage gradually increases in time, such that the output voltage $V_{VGA}$ of the preheating/ignition controller 308 is constantly maintained at a high voltage, thereby increasing a driving frequency of the triangular oscillator 306. As a result, the lamp starts operation during the preheating mode. During the preheating mode, operations of the dead-time controller 314 are constantly maintained at the maximum dead time. If the driving auxiliary power-supply unit of the ballast IC 300 is configured by the capacitor connected to the output terminal, hard switching frequently occurs in the preheating and ignition modes, such that an amount of the current signal received in the capacitor increases, and considerable noise is applied to the power-supply unit, which can cause erroneous operations. In order to prevent erroneous operations, the dead time is maintained essentially at the maximum value. If the dead time increases, the switching driving is substantially similar to the zero-voltage switching or the active zero-voltage switching, thereby solving the problems of noise applied to the power-supply unit.

In the second mode, as denoted by (B) in FIG. 7, the CPH voltage can increase until reaching 5V. For this operation, the output current $I_{CPH}$ of the preheating/ignition controller 308 increases, and the CPH voltage also rapidly increases. During the second mode, the output voltage $V_{VGA}$ of the preheating/ignition controller 308 is proportionally reduced, such that the oscillation frequency is rapidly lowered. In this case, the dead time is reduced in inverse proportion to the CPH voltage.

In the third mode, as denoted by (C) in FIG. 7, the CPH voltage can be higher than 5V, such that the third mode indicates the running mode and the dead-time control mode. In more detail, if the ignition mode is completed and the running mode begins, the output frequency of the triangular oscillator 306 is determined by the first input terminal RT. When the CPH voltage is higher than 5V, the mode detector 320 allows the enable signal ENABLE to assume a high level, such that the dead-time control mode begins by the active zero-voltage switching controller 310.

If the dead-time control mode begins, the first or second mode does not begin although the CPH voltage is less than 5V, and the active zero-voltage switching control operation begins. If the CPH voltage is equal to or less than 2V, as denoted by (E) in FIG. 7, the process for implementing the zero-voltage switching condition by adjusting the dead time fails, such that the system is shut down. In the third mode, the preheating/ignition controller 308 stops operation, such that the output current $I_{CPH}$ of the preheating/ignition controller 308 is constantly maintained. The capacitor $C_{CPH}$ connected to the second input terminal CPH is not used to determine the preheating/ignition mode time, and is used as a compensation capacitor of the dead-time control loop.

Figure 8:
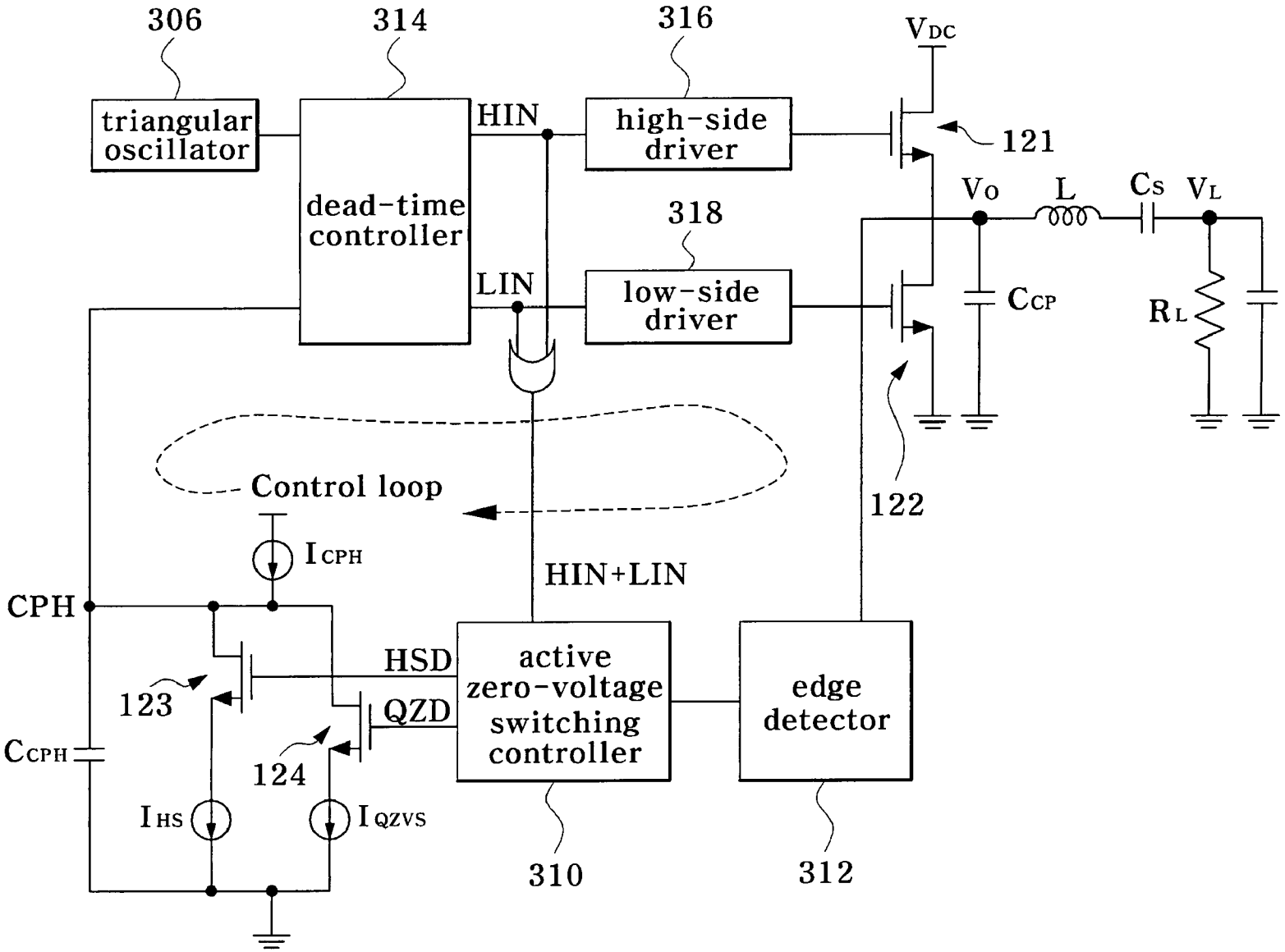
FIG. 8 is a circuit diagram illustrating dead-time control operations of the ballast IC shown in FIG. 5.
Figure 9:
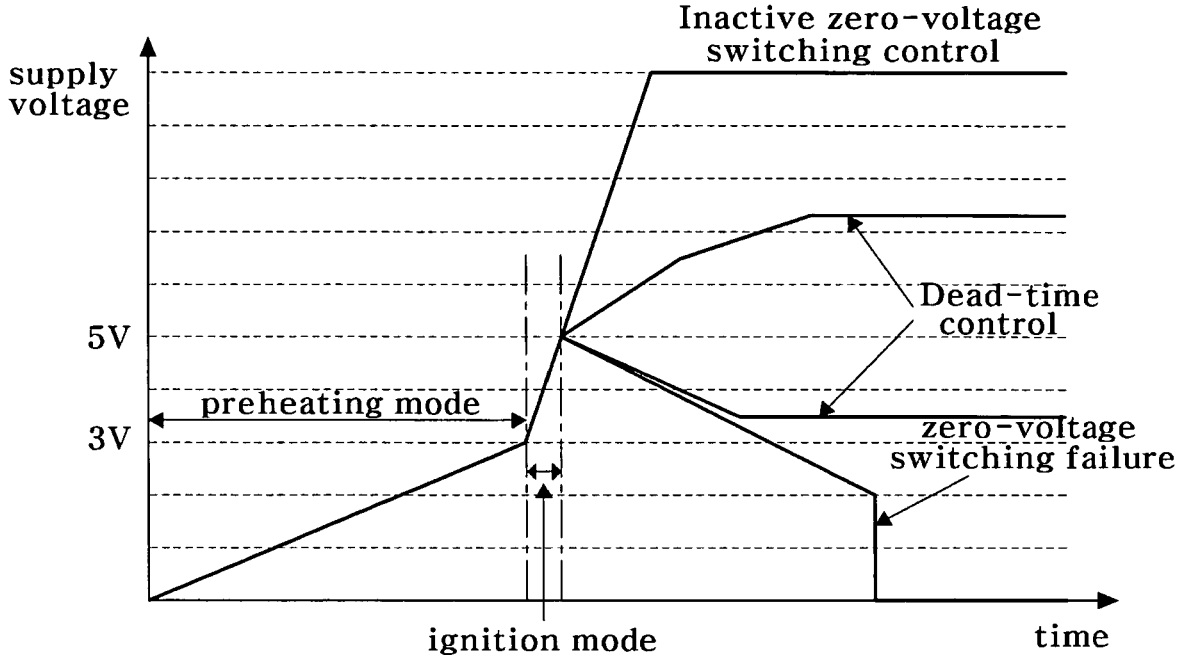
FIG. 9 is a graph illustrating second input terminal (CPH)'s time-variant voltage characteristics during the dead-time control operation of FIG. 8.

FIG. 8 is a circuit diagram illustrating dead-time control operations of the ballast IC shown in FIG. 5. FIG. 9 is a graph illustrating second input terminal (CPH)'s time-variant voltage characteristics during the dead-time control operation of FIG. 8.

In some embodiments, the voltage of the capacitor $C_{CPH}$ connected to the second input terminal CPH is changed by a hard-switching current signal $I_{HS}$ generated from a source terminal of the first MOS transistor 123 and an active zero-voltage switching current $I_{QZVS}$ generated from a source terminal of the second MOS transistor 124. A gate terminal of the first MOS transistor 123 receives the hard-switching detection signal HSD acting as a first output signal of the active zero-voltage switching controller 310. A gate terminal of the second MOS transistor 124 receives the active zero-voltage switching detection signal QZD acting as a second output signal of the active zero-voltage switching controller 310. If each of the hard-switching current signal $I_{HS}$ and the active zero-voltage switching current signal $I_{QZVS}$ is 0V, the capacitor $C_{CPH}$ voltage increases by the output current signal $I_{CPH}$ of the preheating/ignition controller 308, such that the dead time is minimized. The hard-switching current signal $I_{HS}$ and the active zero-voltage switching current signal $I_{QZVS}$ are determined to be higher than the maximum value of the output current signal $I_{CPH}$ of the preheating/ignition controller 308. Therefore, if the hard-switching current signal HIS and the active zero-voltage switching current signal $I_{QZVS}$ are not equal to 0V, the CPH voltage of the second input terminal is reduced so that the dead time increases. As previously stated, if the CPH voltage drops to 2V or less, the process for implementing the zero-voltage switching condition by adjusting the dead time fails, and the system shuts down.

Figure 10A:
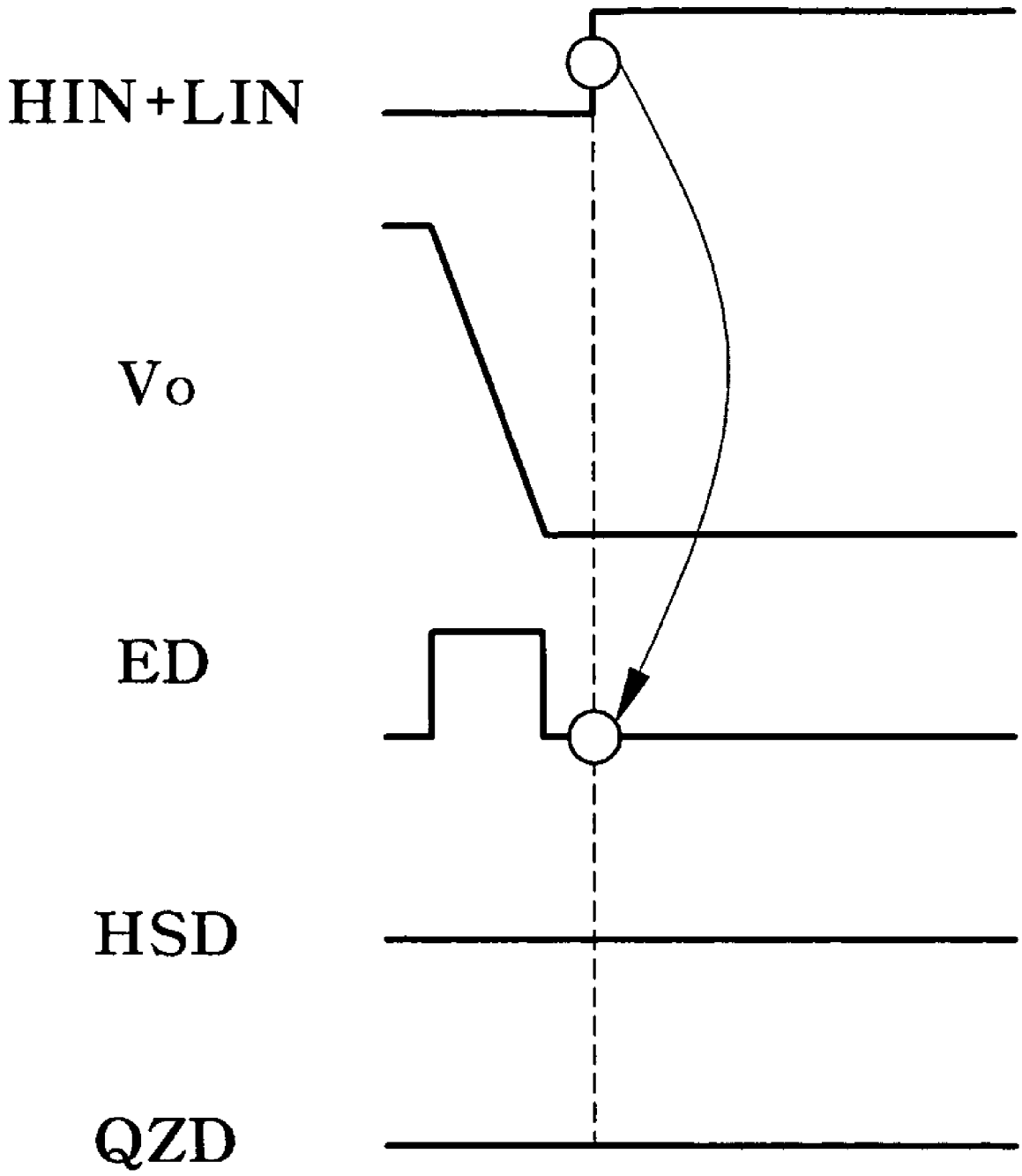
FIGS. 10A-10C are timing diagrams illustrating a plurality of switching-mode detecting operations for use in the ballast IC of FIG. 5.
Figure 10B:
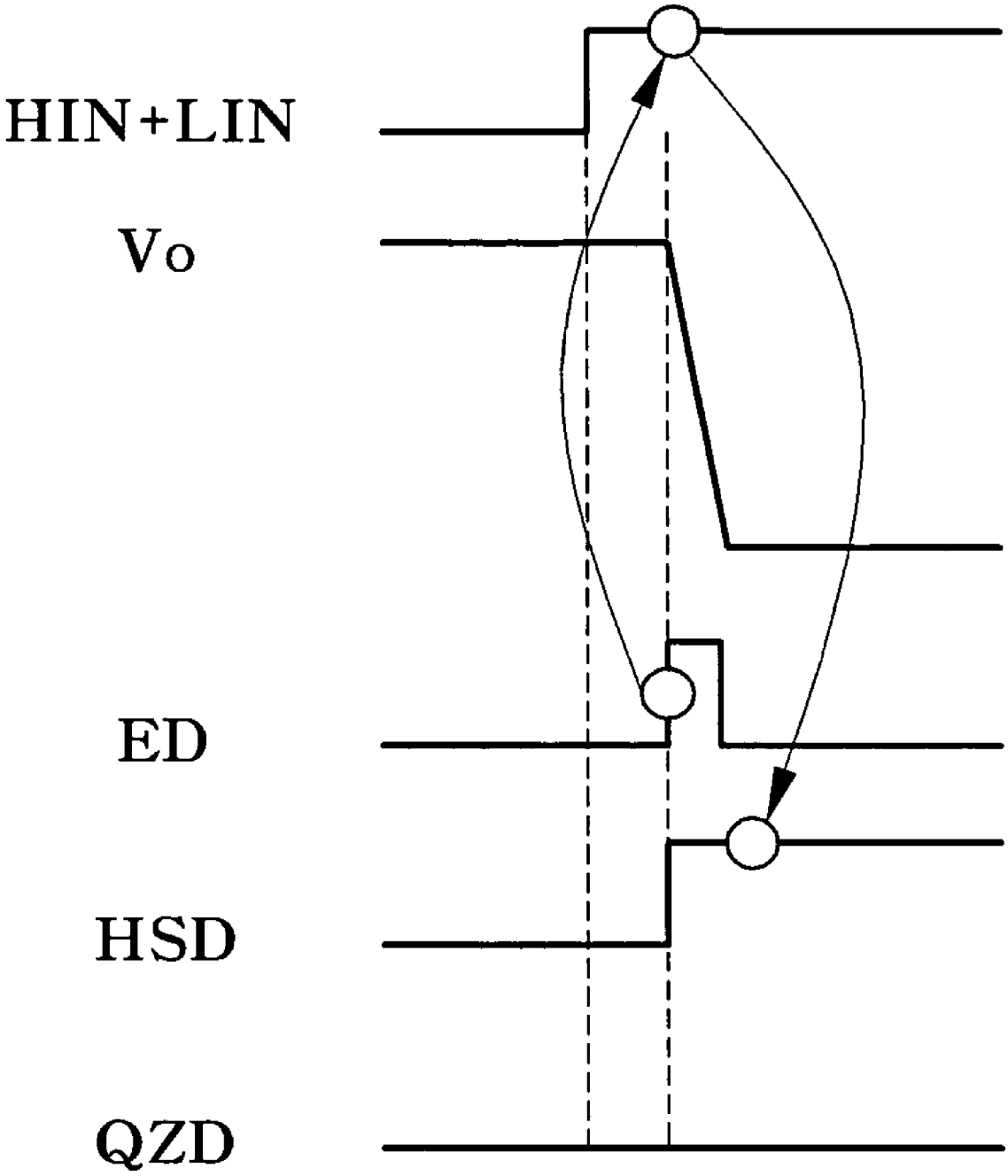
Figure 10C:
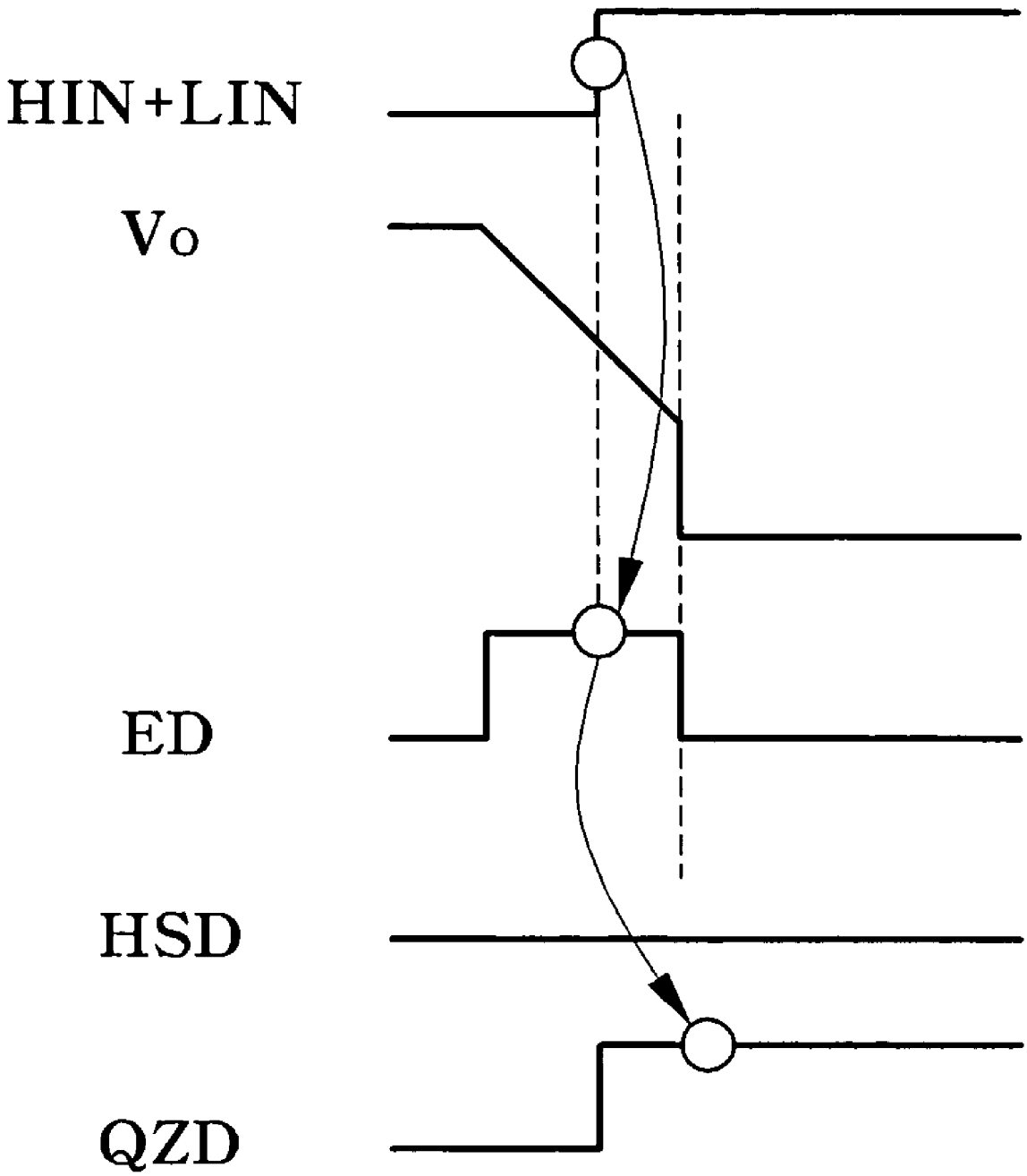

FIGS. 10A-10C are timing diagrams illustrating various switching-mode detecting operations for use in the ballast IC of FIG. 5.

In FIGS. 10A-10C, the high-side input signal HIN is indicative of an input signal for driving the high-side driver 316, the low-side input signal LIN is indicative of an input signal for driving the low-side driver 318.

FIG. 10A illustrates that in some embodiments the low-side input signal LIN is required for the zero-voltage switching. The low-side input signal LIN switches on the second switching element 122 after the voltage of the output node (a) of FIG. 5 drops to 0V. In this case, the hard-switching detection signal HSD generated by the hard switching operation is disabled, and the active zero-voltage switching detection signal QZD generated by the active zero-voltage switching is also disabled. The above-mentioned operation is performed by the edge detection signal ED generated from the edge detector 312 capable of detecting an edge creation time of the output signal. The above-mentioned edge detection signal ED is equal to the output signal of the edge detector 312. A detailed description thereof will be given in relation to FIGS. 12 and 13 below.

FIG. 10B illustrates that the sum HIN+LIN of the high-side input signal HIN and the low-side input signal LIN assuming a high level, and then the voltage $V_o$ of the output node (a) dropping to 0V, or equivalently, the second switching element 122 switching on and the voltage $V_o$ of the output node (a) being equal to 0V, is a hard switching state, having no zero-voltage switching. In this case, the rising edge of the edge detection signal (D) is lagging the rising edge of the sum HIN+LIN of the high-side input signal HIN and the low-side input signal LIN, and the hard switching detection signal HSD assumes a high level.

FIG. 10C illustrates that the active zero-voltage switching indicates a specific switching state in which the output voltage is considerably reduced to almost 0V such that efficiency corresponds to an intermediate value between the hard switching and the zero-voltage switching. In this case, the edge of the voltage $V_o$ of the output node (a) is leading the sum HIN+LIN of the high-side input signal HIN and the low-side input signal LIN, however, the sum HIN+LIN of the high-side input signal HIN and the low-side input signal LIN assumes the high level before the voltage $V_o$ reaches 0V, such that the second switching element is switched on. Therefore, the edge detection signal ED remains in the high level at a rising edge of the sum HIN+LIN of the high-side input signal HIN and the low-side input signal LIN. In this case, the active zero-voltage switching signal QZD assumes the high level.

Figure 11:
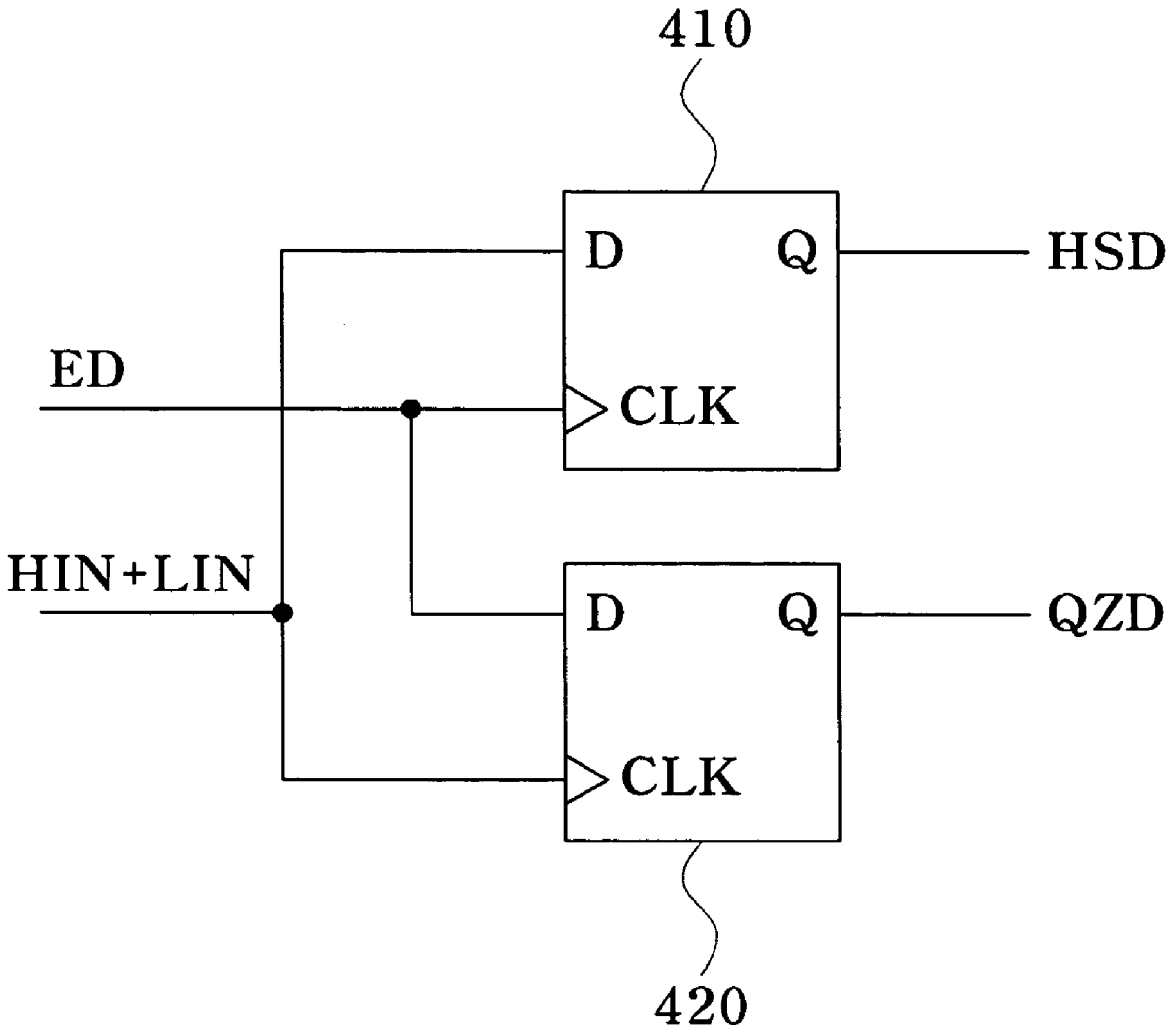
FIG. 11 is a circuit diagram illustrating a detection circuit for detecting the switching-mode detecting operations of FIGS. 10A-10C.

FIG. 11 is a circuit diagram illustrating a detection circuit for detecting the switching-mode detecting operations of FIGS. 10A-10C.

FIG. 11 illustrates that in some embodiments the detection circuit for detecting the hard switching and the active zero-voltage switching includes two D-flip-flops 410 and 420.

The sum HIN+LIN of the high-side input signal HIN and the low-side input signal LIN is applied to the D input terminal of the first D-flip-flop 410 and the clock input terminal of the second D-flip-flop 420. The edge detection signal ED is applied to the clock input terminal CLK of the first D-flip-flop 410 and the D input terminal of the second D-flip-flop 420. The Q output terminal of the first D-flip-flop 410 generates the hard switching detection signal HSD. The Q output terminal of the second D-flip-flop 420 generates the active zero-voltage switching detection signal QZD. In this case, the hard-switching detection signal HSD and the active zero-voltage switching detection signal QZD are adapted to generate the hard switching current signal $I_{HS}$ and the active zero-voltage switching current signal $I_{QZVS}$ received in the active zero-voltage switching controller 310. If the hard switching detection signal HSD assumes a high level, the hard switching current signal $I_{HS}$ is generated so that the voltage of the second input terminal CPH becomes lowered.

The edge detection signal ED is extracted during the above operations. The capacitor may be used to extract the edge signal of the output signal. The charging- or discharging-operation of the capacitor is performed during a short dead-time, and edges occur. In this case, a variation of the edge can be represented by the following equation 1:

$$\frac{dV_o}{dt} = \frac{I_L}{C_{CP}} \quad \text{[Equation 1]}$$

Here $I_L$ is indicative of an inductor current. If the capacitor is connected to the output terminal at which the above-mentioned edge variation occurs, and the other output terminal is grounded, the current signal of the capacitor can be represented by the following equation 2:

$$I = C\frac{dV_o}{dt} = C\frac{I_L}{C_{CP}} \quad \text{[Equation 2]}$$

The capacitor current I occurs at the output edge, and has a constant value. Therefore, if the capacitor current I is received in the voltage/current converter, a desired voltage signal capable of being generated at only the edge can be acquired. If the above-mentioned signal is detected by comparators, the rising/falling edges can be recognized, and the edge detection signal ED can also be acquired by the sum of the rising edge and the falling edge.

Figure 12:
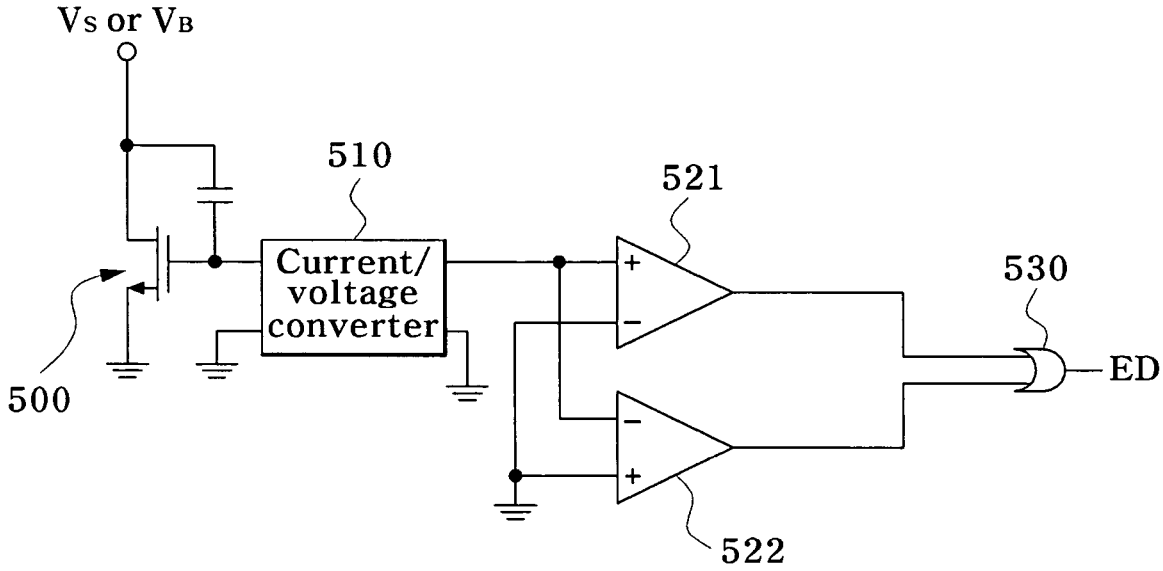
FIG. 12 is a circuit diagram illustrating an example of an edge detection circuit of the ballast IC of FIG. 5.

FIG. 12 is a circuit diagram illustrating an example of an edge detection circuit of the ballast IC of FIG. 5.

FIG. 12 illustrates that in some embodiments, in the case of using a lateral double diffused MOS (LDMOS) transistor 500, the LDMOS transistor 500 has a parasitic capacitor $C_{gd}$. The output signal of the current/voltage converter 510 is applied to a positive (+) input terminal of the first comparator 521 and a negative (−) input terminal of the second comparator 522. The negative (−) input terminal of the first comparator 521 and the positive (+) input terminal of the second comparator 211 are grounded. The first comparator 521 and the second comparator 522 can be operational amplifiers (OP-amps). The output signal of the first comparator 521 is the rising edge detection signal. The output signal of the second comparator 522 is the falling edge detection signal. The above-mentioned output signals of the first and second comparators 521 and 522 are applied to the OR gate 530, and the OR gate outputs the edge detection signal ED.

Generally, the capacitor capable of enduring high voltages is coupled to an external part in order to detect the edge signal. However, in the case of the parasitic capacitor $C_{gd}$ of the high-voltage LDMOS transistor 500, the edge detection circuit occupies a small-sized area simultaneously with enduring the high voltage. The magnitude of the parasitic capacitor $C_{gd}$ can be controlled by adjusting the size of the LDMOS transistor 500.

Edge information of the output signal should be applied to the drain terminal of the LDMOS transistor 500. For this purpose, the drain terminal of the LDMOS transistor 500 is connected to the output terminal VS or VB of the high-side driver 316 contained in the ballast IC 300. If transition occurs in the output signal, the current signal flows in the parasitic capacitor $C_{gd}$, and is then converted into a voltage signal by the current/voltage converter 510. If the output signal increases, the positive (+) voltage is applied to the current/voltage converter 510. Otherwise, if the output signal decreases, the negative (−) voltage is applied to the current/voltage converter 510. The output voltage is applied to the first and second comparators 521 and 522, and the edge detection signal ED is created by the OR gate 530.

Figure 13:
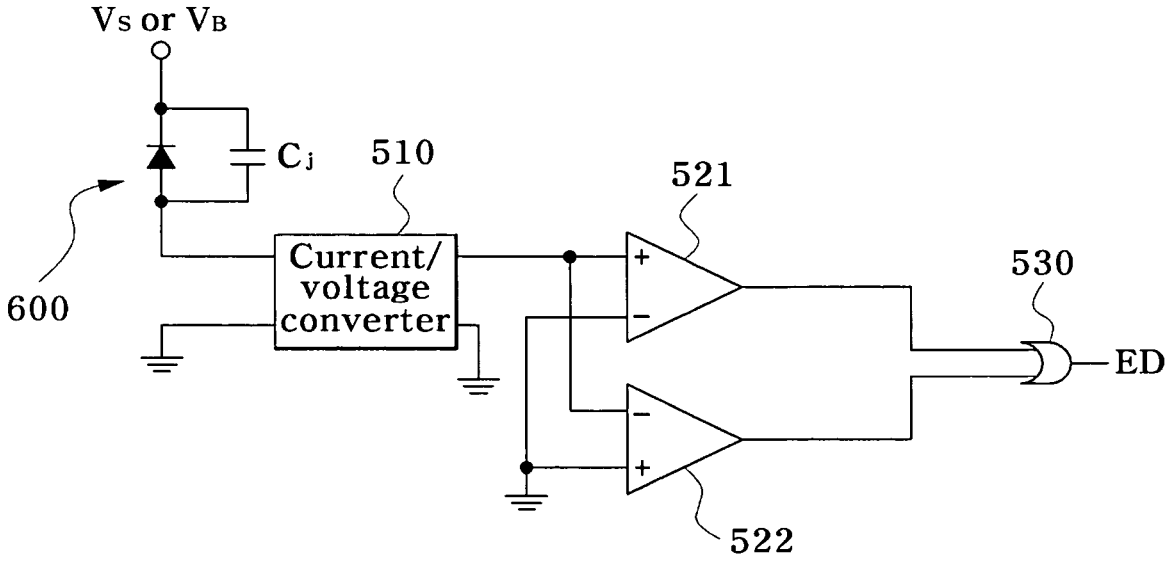
FIG. 13 is a circuit diagram illustrating another example of an edge detection circuit of the ballast IC of FIG. 5.

FIG. 13 is a circuit diagram illustrating another example of an edge detection circuit of the ballast IC of FIG. 5. In FIG. 13, the same numerals as those of FIG. 12 indicate the same elements as those of FIG. 12.

FIG. 13 illustrates that in some embodiments a parasitic capacitance $C_j$ is present at a junction of a high-voltage diode 600. In FIG. 13, an anode of the high-voltage diode 600 is connected to the current/voltage converter 510, a cathode of the high-voltage diode 600 is connected to the output terminal VS or VB of the high-side driver 316 contained in the ballast IC 300. The above-mentioned operations of the edge detection circuit are the same as those of FIG. 12.

Figure 14:
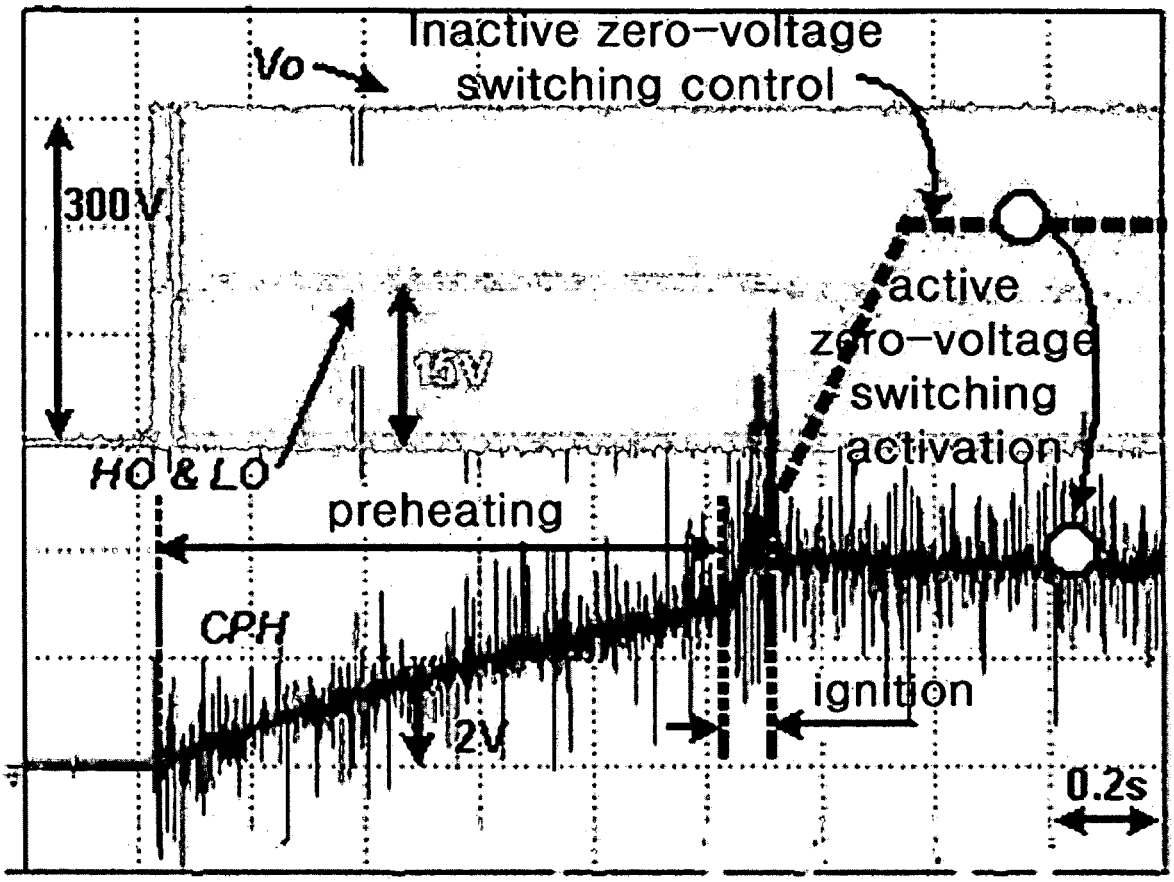
FIG. 14 is a waveform diagram illustrating operations of the ballast IC of FIG. 5.

FIG. 14 is a waveform diagram illustrating operations of the ballast IC of FIG. 5. FIG. 14 illustrates that in some embodiments the CPH voltage of the second input terminal gradually increases in the preheating mode. During the preheating mode, an inverter acting as a driving circuit of the fluorescent lamp is driven. If the CPH voltage rapidly increases in the vicinity of 3V, the ignition mode begins. If the active zero-voltage switching control is not performed, i.e., if an inactive zero-voltage switching (also called a passive zero-voltage switching) is performed, the CPH voltage continuously increases until reaching about 10V. If the CPH voltage is higher than 5V, the dead-time control mode begins. In the dead-time control mode, the CPH voltage is changed by the active zero-voltage switching current $I_{QZVS}$ and the hard switching current signal $I_{HS}$ which are output current signals of the dead-time controller 314. In other words, during the dead-time control mode, the ballast IC performs the active zero-voltage switching operation capable of automatically adjusting the dead time according to load characteristics.

Figure 15:
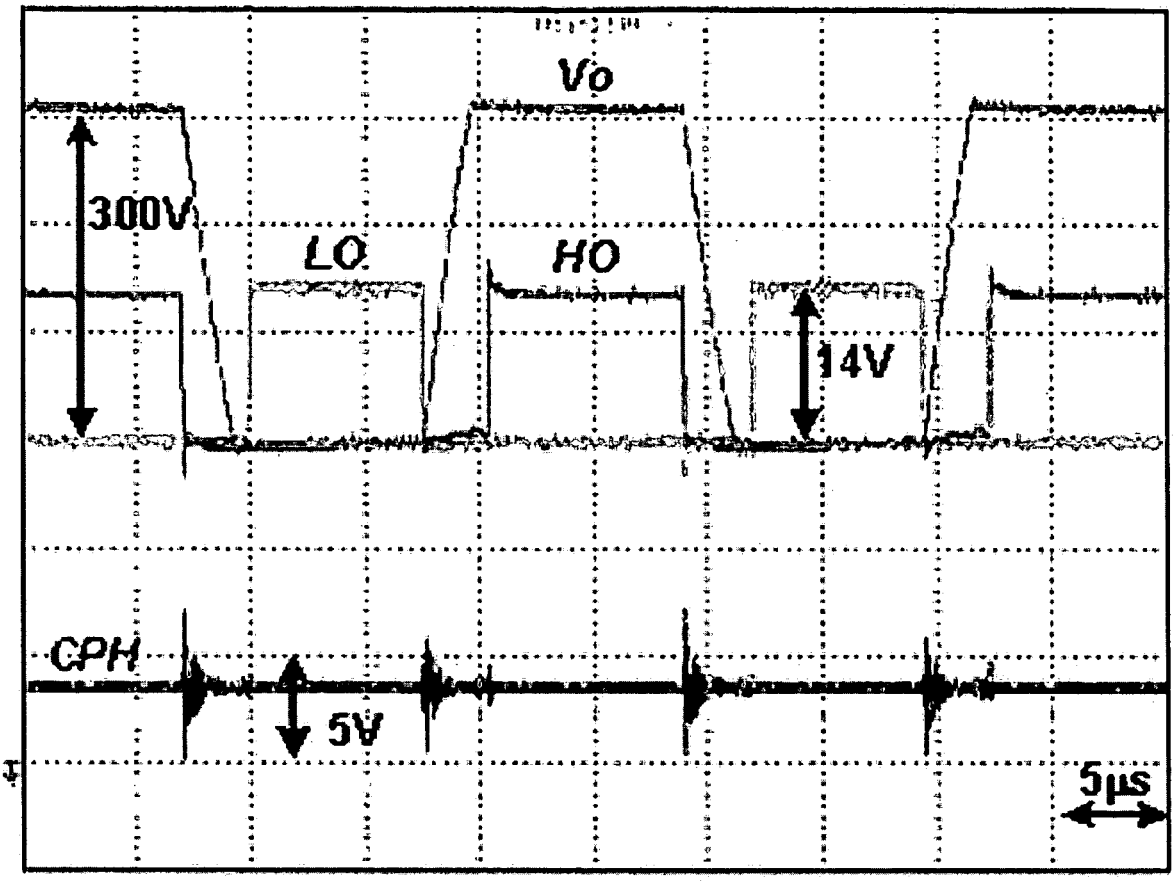
FIG. 15 is a waveform diagram illustrating zero-voltage switching operations of the ballast IC of FIG. 5.

FIG. 15 is a waveform diagram illustrating zero-voltage switching operations of the ballast IC of FIG. 5. FIG. 15 illustrates that in some embodiments, during a specific period in which the output signal HO of the high-side driver 316 and the output signal LO of the low-side driver 318 are in the dead-time period, the output voltage $V_o$ is changed from 0V to 300V by the active zero-voltage switching control operation, such that it can be recognized that the zero-voltage switching operations of the first and second switching elements 121 and 122 are satisfied.

Figure 16:
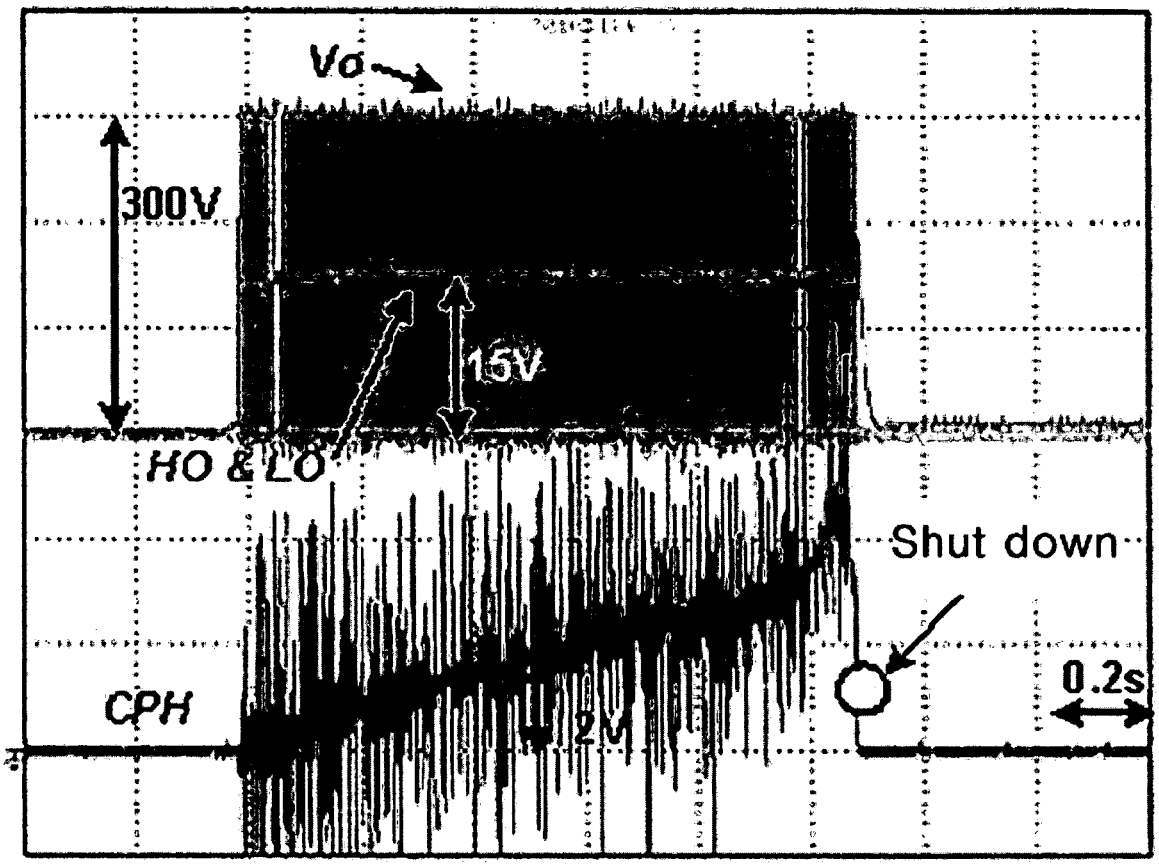
FIG. 16 is a waveform diagram illustrating a shutdown-mode entering operation of the ballast IC of FIG. 5.

FIG. 16 is a waveform diagram illustrating an operation entering shutdown-mode by the ballast IC of FIG. 5. FIG. 16 illustrates that in some embodiments, if the lamp is separated from the ballast IC, the active zero-voltage switching circuit automatically detects the hard switching state, such that it controls the system to be shut down.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. A ballast integrated circuit (IC) for driving a first switching element and a second switching element, comprising:

a variable gain amplifier (VGA) connected to a first input terminal connected to a resistor for generating an output current signal according to a resistance value of the resistor and a gain control signal;

a preheating/ignition controller connected to a second input terminal connected to a capacitor, for generating an output current signal and an output voltage signal acting as the gain control signal according to a voltage of the second input terminal;

an active zero-voltage controller for generating a hard-switching current signal and an active zero-voltage switching current signal, such that it adjusts the voltage of the second input terminal according to switching states of the first switching element and the second switching element;

an oscillator for generating an oscillation signal upon receiving the output current signal from the variable gain amplifier (VGA); and a dead-time controller for receiving the voltage signal of the second input terminal and an output signal of the oscillator, adjusting a dead time using the received signals, and generating driving signals of the first and second switching elements.

2. The ballast integrated circuit (IC) according to claim 1, further comprising:

a voltage/current converter for converting a voltage signal of the first input terminal into a current signal, and transmitting the current signal to the variable gain amplifier (VGA).

3. The ballast integrated circuit (IC) according to claim 1, further comprising:

an edge detector for detecting a rising- or falling- edge generated at an output voltage of an output unit equipped with the first and second switching elements using a first or second terminal of an auxiliary power-supply unit capable of driving the first switching element, generating an edge detection signal, and transmitting the edge detection signal to the active zero-voltage switching controller.

4. The ballast integrated circuit (IC) according to claim 3, the edge detector comprising a MOS transistor, wherein a first terminal of the MOS transistor is coupled to the first or second terminal of the auxiliary power-supply unit, and allows a current signal proportional to a variation of the output voltage to flow in a parasitic capacitor located between the first terminal and a second terminal of the MOS transistor.

5. The ballast integrated circuit (IC) according to claim 3, wherein the edge detector comprises a diode, wherein a first terminal of the diode is coupled to a first or second terminal of the auxiliary power-supply unit, and allows a current signal proportional to a variation of the output voltage to flow in a parasitic capacitor located between the first terminal and the second terminal of the diode.

6. The ballast integrated circuit (IC) according to claim 5, wherein the edge detector comprises:

a diode including the parasitic capacitor located between the first terminal and the second terminal, connecting the first terminal to the first or second terminal of the auxiliary power-supply unit, and receiving an amount of the variation of the output voltage;

a voltage/current converter for converting a current signal generated from the second terminal of the diode into a voltage signal;

first and second comparators for generating a rising-edge detection signal and a falling-edge detection signal according to an output signal of the voltage/current converter, respectively; and an OR gate for receiving the rising-edge detection signal and the falling-edge detection signal, performing a logic OR operation on the received detection signals, and generating the OR-operation resultant signal as the edge detection signal.

7. The ballast integrated circuit (IC) according to claim 3, wherein the active zero-voltage switching controller is configured to determine whether the first and second switching elements perform a hard switching operation or a zero-voltage switching operation by referring to the edge detection signal, whereby if the hard switching operation is determined, the active zero-voltage switching controller generates the hard-switching current signal, and if the active zero-voltage switching operation is determined, the active zero-voltage switching controller generates the active zero-voltage switching current signal.

8. The ballast integrated circuit (IC) according to claim 1, wherein the edge detector comprises:

a MOS transistor including the parasitic capacitor located between the first terminal and the second terminal, connecting the first terminal to the first or second terminal of the auxiliary power-supply unit, and receiving an amount of the variation of the output voltage;

a voltage/current converter for converting a current signal generated from the second terminal of the MOS transistor into a voltage signal;

first and second comparators for generating a rising-edge detection signal and a falling-edge detection signal according to an output signal of the voltage/current converter, respectively; and an OR gate for receiving the rising-edge detection signal and the falling-edge detection signal, performing a logic OR operation on the received detection signals, and generating the OR-operation resultant signal as the edge detection signal.

9. The ballast integrated circuit (IC) according to claim 1, further comprising:

a mode detector for determining whether a preheating mode and an ignition mode are completed by referring to the voltage of the second input terminal, and transmitting an enable signal to the active zero-voltage switching controller after detecting the completion of the preheating and ignition modes.

10. The ballast integrated circuit (IC) according to claim 9, wherein the mode detector, if the voltage of the second input terminal is equal to or higher than a predetermined value, recognizes a dead-time control mode, generates the enable signal, stops an operation of the preheating/ignition controller, and activates an operation of the active zero-voltage switching controller.

11. The ballast integrated circuit (IC) according to claim 9, further comprising:

an under voltage lock-out (UVLO) unit for transmitting a reset signal to the mode detector if a power-supply voltage is equal to or less than a predetermined value required for normal operations, thereby stopping an operation of the ballast IC.

12. The ballast integrated circuit (IC) according to claim 9, wherein the mode detector, if the voltage of the second input terminal is equal to or higher than a predetermined magnitude, recognizes a dead-time control mode, generates the enable signal, stops an operation of the preheating/ignition controller, and activates an operation of the active zero-voltage switching controller, determines if the voltage of the second input terminal is equal to or less than a predetermined magnitude, and finally stops an operation of the ballast IC when the voltage of the second input terminal is equal to or less than a predetermined magnitude.

* * * * *